United States Patent [19]

Koyama

[11] 4,343,977

[45] Aug. 10, 1982

[54] ELECTRONIC CONTROLLED HEAT COOKING APPARATUS

[75] Inventor: Hideaki Koyama, Otsu, Japan

[73] Assignee: Sanyo Electric Co., Ltd., Moriguchi, Japan

[21] Appl. No.: 189,587

[22] Filed: Sep. 23, 1980

[30] Foreign Application Priority Data

Sep. 26, 1979 [JP] Japan ..... 54-124309
Sep. 28, 1979 [JP] Japan ..... 54-126063

[51] Int. Cl.[3] ..... H05B 9/06

[52] U.S. Cl. ..... 219/10.55 B; 219/492; 219/493; 219/506; 340/359; 340/364

[58] Field of Search ..... 219/10.55 B, 10.55 F, 219/490, 491, 492, 493, 494, 506; 364/900; 340/347 R, 345, 359, 364, 146.1 A, 146.1 AC

[56] References Cited

U.S. PATENT DOCUMENTS 4,158,432 6/1979 Van Bavel ..... 219/10.55 B
4,225,776 9/1980 Meisner et al. ..... 219/494
4,233,498 11/1980 Payne et al. ..... 219/490
4,234,784 11/1980 Totterdell ..... 219/10.55 B

*Primary Examiner*—B. A. Reynolds
*Assistant Examiner*—M. Paschall
*Attorney, Agent, or Firm*—Darby & Darby

[57] ABSTRACT

An electronic controlled heat cooking apparatus employs a microprocessor for the purpose of controlling a heating operation. The microprocessor is responsive to a timer time period set by a timer apparatus to control oscillation of a microwave. The timer apparatus comprises a conductive path pattern, an operation knob, and a brush provided in a ganged fashion with the operation knob to be in sliding contact with the conductive path pattern. Timer time period information is stored responsive to a code signal determined by the conductive path pattern as a function of the stop position of the brush. Renewal of the timer time period of the information as stored is made in the case where the brush is displaced by more than a predetermined amount on the conductive path pattern. Furthermore, in the case where displacement occurs within a predetermined time period after the previous displacement, the timer time period information is renewed.

11 Claims, 22 Drawing Figures

201c

| | 0 | 1 | 2 | 3 | 4 | 5 | 6 | 7 | 8 | 9 | A | B | C |
|---|---|---|---|---|---|---|---|---|---|---|---|---|---|
| 0 | DISPLAY | | | | NT | | FKB | | | | | | |
| 1 | CLOCK | | | | OT 1 | | FLG | | | | | | |
| 2 | TIME 1 | | | | OT 2 | | COU-NT | | | | | | |
| 3 | TIME 2 | | | | | | | | | | | | |

| FLG | FLG 1 | FLG 2 | FLG 3 | FLG 4 | FLG 5 | FLG 6 | FLG 7 | FLG 8 | FLG 9 | FLG 10 | FLG 11 | FLG 12 | FLG 13 |
|---|---|---|---|---|---|---|---|---|---|---|---|---|---|

ST

ELECTRONIC CONTROLLED HEAT COOKING APPARATUS

BACKGROUND OF THE INVENTION

1. Field of the Invention

The present invention relates to an electronic controlled heat cooking apparatus. More specifically, the present invention relates to an electronic controlled heat cooking apparatus such as a microwave oven which employs a microprocessor for controlling a heat cooking.

2. Description of the Prior Art

Of late a microprocessor has been utilized in a heat cooking apparatus such as a microwave oven, in the light of the advantage that a variety of cooking modes can be performed with a relatively simple structure. In case of such an electronic controlled heat cooking apparatus employing a microprocessor, it is necessary to enter information for control to the microprocessor. It has been common that entry means of the so-called ten-key type has been employed as such information entry means. Accordingly, even in entering a timer time period for the purpose of a timer operation mode, for example, the ten-key type entry means had to be operated; however, it was not easy to operate such entry means for setting the above described timer time period to an operator not familiar with an arrangement of keys in the ten-key type entry means.

Therefore, an electronic controlled heat cooking apparatus was adapted for setting a timer time period by means of a displaceable operating member, such as in the case of a microwave oven employing a microprocessor. In such cooking apparatus, the displaceable member is displaced by manual operation of the displaceable member by an operator, whereby the timer time period information is provided in association with the operated position of the displaceable member. However, in case of such electronic controlled heat cooking apparatus having such timer means, it could happen that the displaceable member is displaced even due to mechanical vibration of the cooking apparatus per se. In such a case, a timer time period not in line with the operator's intention is set, with a resultant problem that an unexpected cooking operation is performed. Some type of cooking apparatuses comprises a cooking apparatus structured such that, when a desired timer time period is set and the set timer time period is changed in the course of the heating operation being effected in accordance with the originally set timer time period, a heating operation is renewedly performed in accordance with the new changed timer time period. In case of such cooking apparatus, assuming that a time period of 20 minutes is initially set, for example, whereupon a heating operation is performed, and the displaceable member is displaced due to mechanical vibration, such as vibration caused by opening and closing of the door, for example, immediately before termination of the originally set timer time period, and the timer time period is changed to say 20 minutes 15 seconds, for example, then the cooking apparatus renewedly performs a heat cooking operation in accordance with the changed timer time period of 20 minutes 15 seconds. Consequently, a heat cooking operation is performed for an extraordinarily long period of time far exceeding the originally intended timer time period of 20 minutes.

SUMMARY OF THE INVENTION

The present invention comprises a heat cooking apparatus for controlling a heating time period responsive to a timer apparatus, which comprises an operation knob and a displacement member displaceable in a ganged fashion with the operation knob. The displacement member is displaceable from a predetermined origin point over a predetermined range and the timer time period information is stored responsive to a displacement amount from the origin point of the displacement member. Unless the displacement member is displaced by more than a predetermined amount, the timer time period information as stored will not be renewed. Therefore, according to the present invention, even if the displacement member is undesirably displaced due to mechanical vibration or the like of the cooking apparatus per se without regard to operation of the timer apparatus by an operator, the timer time period information will not be renewed responsive to such displacement. Accordingly, the timer time period as originally set will not be undesirably prolonged to achieve a heat cooking operation for a time period longer than a scheduled time period.

In a preferred embodiment of the present invention, the displacement member is implemented with a conductive material and is structured to be commonly in sliding contact with a plurality of conductive path patterns. The conductive path patterns extend for the above described predetermined range from the origin point of the displacement member, while the above described predetermined range is divided into a plurality of sections. The respective conductive paths are structured to be cooperative to provide a code signal, so that a different code is provided for each section of these conductive paths so as to be determined selectively by the conductive surfaces, as exposed, of the respective conductive paths.

For the purpose of detecting whether the displacement member has been displaced by more than a predetermined amount, a preferred embodiment of the present invention is adapted to detect whether a numerical value represented by the above described code signal has changed by more than a predetermined value. In another preferred embodiment of the present invention, switch means is provided for each section of the conductive path patterns, so that displacement more than the above described predetermined amount of the displacement member is detected responsive to the switching of the switch means. According to the preferred embodiment in discussion, timer time period information is prevented from being set against the operator's intention by means of a relatively simple structure, with the result that an extremely stable timer control can be performed.

Accordingly, a principal object of the present invention is to provide an electronic controlled heat cooking apparatus employing a timer apparatus including a displacement member, wherein timer time period information is prevented from being undesirably set.

Another object of the present invention is to provide an electronic controlled heat cooking apparatus, wherein timer time period information is prevented from being renewed, unless a displacement member of a timer apparatus is displaced more than a predetermined amount.

A further object of the present invention is to provide an electronic controlled heat cooking apparatus employing a microprocessor as controlling means, wherein timer time period information can be set with ease, while timer time period information is prevented from being undesirably set.

Still a further object of the present invention is to provide an electronic controlled heat cooking apparatus, wherein a stabled timer control is achieved with a relatively simple structure.

These objects and other objects, features, aspects and advantages of the present invention will become more apparent from the following detailed description of the present invention when taken in conjunction with the accompanying drawings.

DESCRIPTION OF THE PREFERRED EMBODIMENTS

In the following detailed description of the preferred embodiments of the present invention, the present invention will be described as advantageously employed in a microwave oven. However, it should be pointed out that the present invention is not limited to such embodiments but the present invention can be employed in any other types of heat cooking apparatuses for cooking a material being cooked by application of heat thereto, such as a gas oven, an electric oven, an electric grill, and electric roaster and the like.

Figure 1:
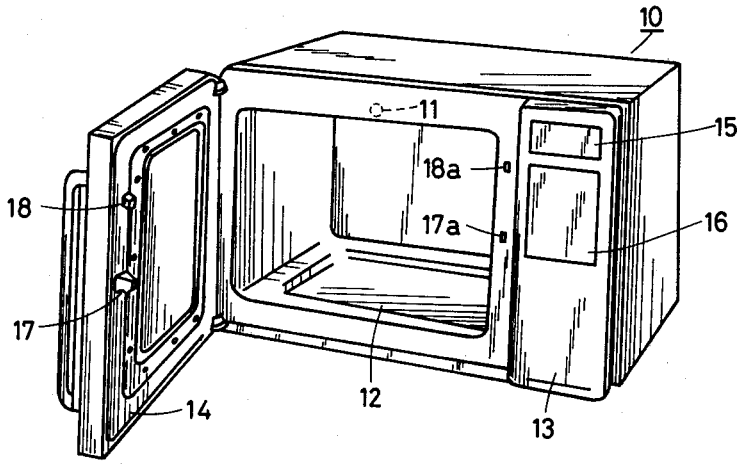
FIG. 1 is a perspective view of a microwave oven shown as one example of an electronic controlled heat cooking apparatus, which constitutes the background of the invention and wherein the present invention can be advantageously employed.

FIG. 1 is a perspective view of a microwave oven embodying the present invention. A microwave oven 10 has a main body comprising a cooking chamber 12 and a control panel 13. The main body of the microwave oven has a door 14 openably/closably provided to enclose an opening of the cooking chamber 12. The control panel 13 comprises an operation portion 16 for setting various cooking modes and for entering necessary data, and a display 15 for displaying in a digital manner the entered data, a measured temperature, a time period left in a timer, and the like. The display portion 15 and the operation portion 16 will be described in more detail subsequently. The door 14 is provided with a door latch 17 and a door switch knob 18 on the inner surface thereof. The door latch 17 and the door switch knob 18 are adapted to enter into apertures 17*a* and 18*a*, respectively, formed on the main body, when the door 14 is closed, so that an interlock switch and a door switch, respectively, shown in FIG. 6, may be turned on.

Figure 6:
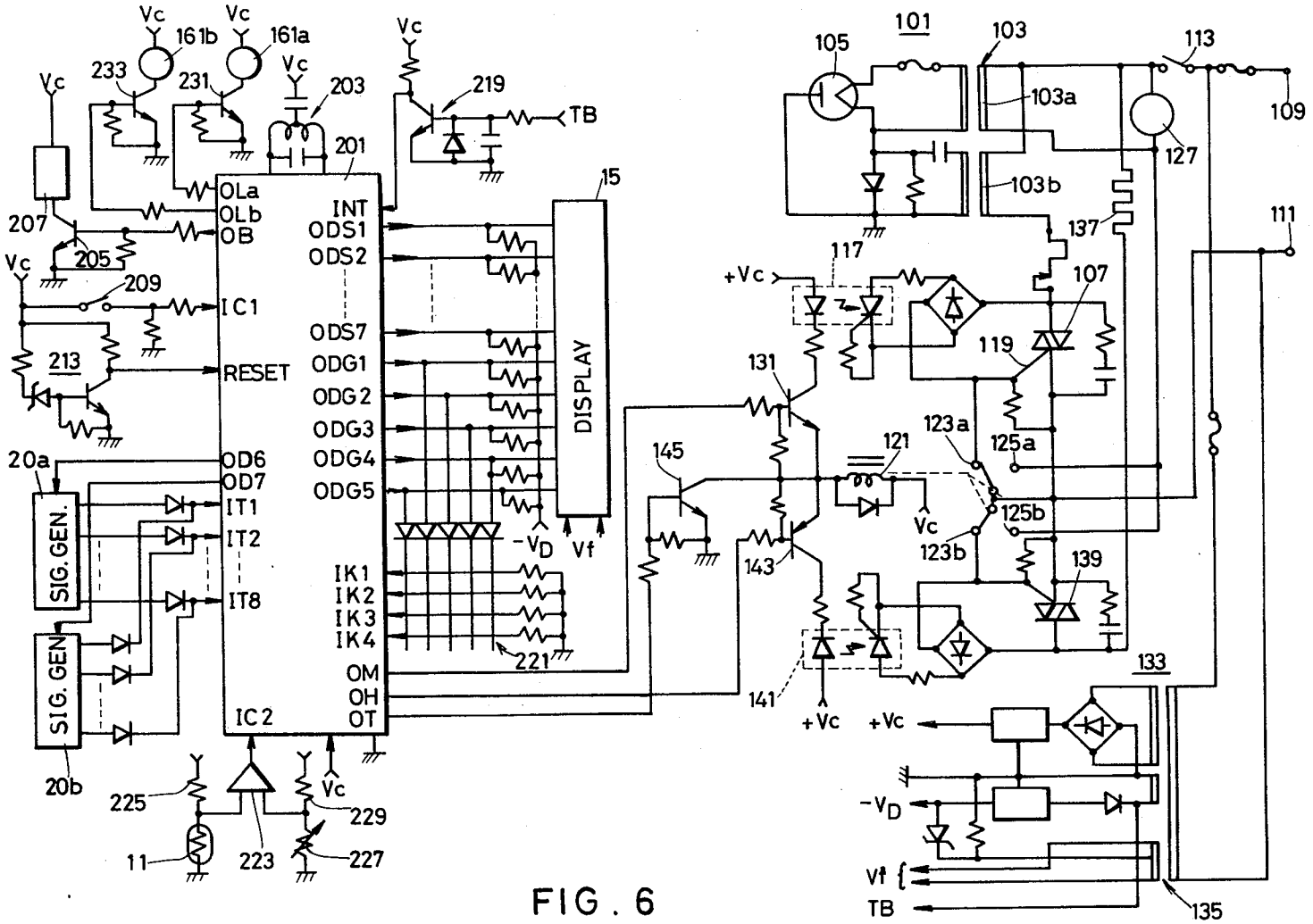
FIG. 6 is a schematic diagram of one embodiment of the present invention.

FIG. 6 is a schematic diagram of a preferred embodiment of the present invention. A microwave generating portion 101 is coupled to terminals 109 and 111 of a commercial power supply through an interlock switch 113 and a bidirectional thyristor 107. The microwave generating portion 101 is structured in a well known manner and may comprise a high voltage transformer 103 for transforming a source voltage obtained from the terminals 109 and 111, a magnetron 105 coupled to the output winding of the high voltage transformer 103, and the like. The interlock switch 113 is adapted to be turned on by means of the door latches 17 and 17*a*, shown in FIG. 1. The bidirectional thyristor 107 is rendered conductive if and when the output voltage of a photocoupler 117 is applied to the gate electrode 119 thereof. Accordingly, if and when the door 14 shown in FIG. 1 is closed and the output voltage is obtained from the photocoupler 117, an alternating source voltage obtained from the terminals 109 and 111 is applied to the microwave generating portion 101 and accordingly a microwave is generated from the microwave generating portion 101, which microwave energy is supplied to the cooking chamber 12 shown in FIG. 1. The photocoupler 117 becomes operative if and when two transistors 145 and 131 are both rendered conductive, whereby an output voltage is withdrawn. It is pointed out that the embodiment is structured to achieve a heat operation by a microwave oven and also to achieve a heat operation by a heater. To that end, the embodiment comprises a bidirectional thyristor 139 which is similar to the bidirectional thyristor 107. The bidirectional thyristor 139 is used to control a power supply to a heater 137. A transistor 143, a photocoupler 141 and so on are provided in association with the bidirectional thyristor 139, as is similar to the bidirectional thyristor 107. The heater 137 is connected through an interlock switch 113 and the bidirectional thyristor 139 to the power supply terminals 109 and 111. The heater 137 is mounted on the upper wall of the cooking chamber 12 (FIG. 1), so that when the same is energized, the same is red heated, whereby the heating energy is applied to a material being cooked. If and when the transistors 145 and 143 are both rendered conductive, a signal is applied from the photocoupler 141 to the gate electrode of the bidirectional thyristor 139, whereby the heater 137 is supplied with an electric power. The thyristor 107 is rendered conductive responsive to a signal from a photocoupler 117, when the transistors 145 and 131 are both rendered conductive, whereby the magnetron 105 is energized to generate a microwave. The relay 121 is energized when the transistor 145 is rendered conductive, whereby two normally open contacts 125*a* and 125*b* are closed while two normally closed contacts 123*a* and 123*b* are opened. Accordingly, upon energization of the relay 121, the blower motor 127 is energized and the current flows through the high voltage input winding 103*a* of the high voltage transformer 103. As a result, the cathode of the magnetron 105 is supplied with a current. The above described transistors 131, 143 and 145 are controlled to be conductive or non-conductive responsive to the outputs obtained at the output terminals OM, OH and OT of the microprocessor 201. The voltage source terminals 109 and 111 are further connected to a control voltage source 133. The control voltage source 133 comprises a transformer 135 for transforming the voltage supplied from the terminals 109 and 111 to a lower voltage for supplying direct current source voltages $V_C$ and $-VD$ fed to various portions of the circuit, a voltage Vf fed to a display 15 and a time base signal TB.

The embodiment shown employs a one-chip microprocessor implemented as a large scale integration for controlling the above described microwave generating portion 101 and the like. The microprocessor 201 may be model "μPD553" manufactured by Nippon Electric Company Limited, Japan, for example. Such microprocessor 201 has a multiplicity of input and output terminals. Connection terminals OSC1 and OSC2 are used for connecting an external component 203 constituting a portion of a clock source. The external component 203 is cooperative with the microprocessor 201 to generate a synchronizing clock, so that the microprocessor 201 may execute the program steps in synchronism with the clock. Although not shown in the figure, the microprocessor 201 comprises a read only memory having system programs to be described subsequently, a random access memory for storing data, an arithmetic logic unit and the like, as well known to those skilled in the art.

Figure 3:
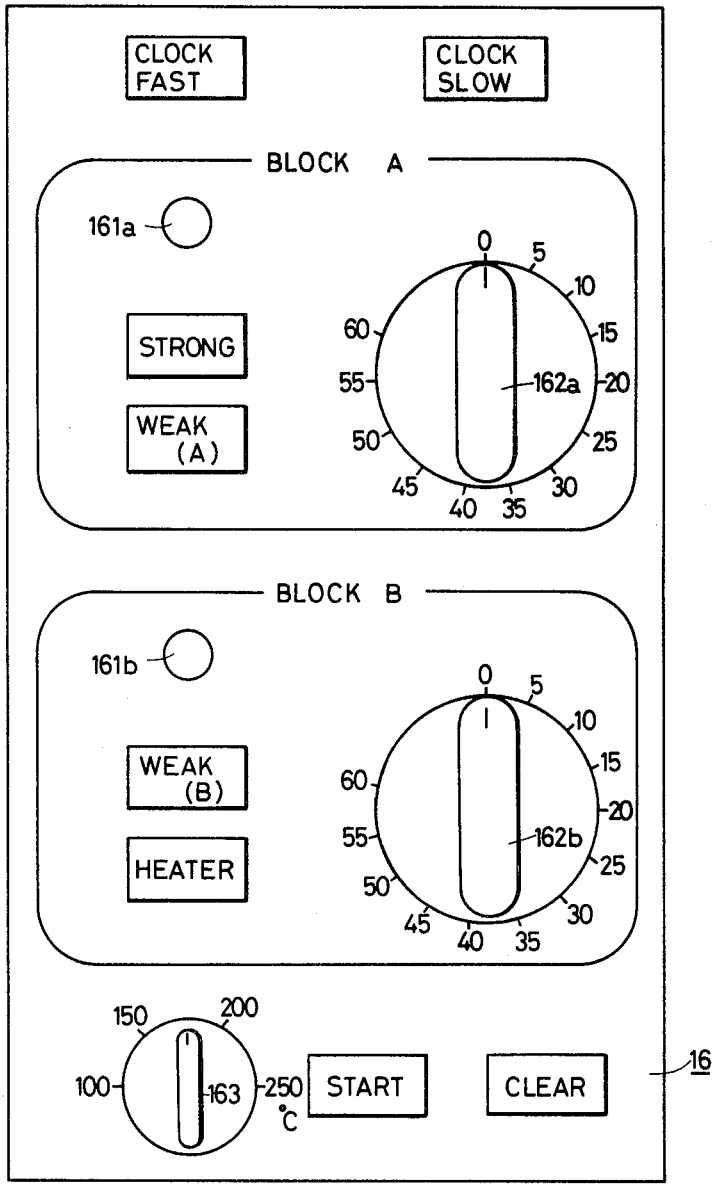
FIG. 3 is a view showing one example of an operation portion.

The microprocessor 201 is coupled to the display 15 through data output terminals ODS1 to ODS7. The display 15 is further supplied with a display control signal through control signal output terminals ODG1 to ODG5. The display control signal functions as a digit selecting signal for driving in a time sharing basis each of display digit to be described subsequently of the display 15. The control signal terminals ODG1 to ODG5 are coupled to column lines of a key matrix 221. The key matrix 221 comprises four row lines connected to key input terminals IK1, IK2, IK3 and IK4 of the microprocessor 201. The above described column lines and row lines constitute a matrix, such that an intersection of each column line and each row line is provided with a key switch of the operation portion 16 (see FIG. 3). The operation portion 16 comprises five function keys, as shown in FIG. 3. The operation portion 16 comprises a MICROWAVE STRONG key and a MICROWAVE WEAK (A) key, a display lamp 161*a*, and timer operation knob 162*a* in the region in a circle indicated as "BLOCK A". The operation portion 16 further comprises a MICROWAVE WEAK (B) and a HEATER key, a display lamp 161*b* and a timer operation knob 162*b* in the region in a circle indicated as "BLOCK B". The operation portion 16 further comprises a CLOCK FAST key, a CLOCK SLOW key, a START key, a CLEAR key, and a temperature adjustment knob 163 disposed outside the above described circles. The above described keys may each comprise an ordinary contact type push button switch. The temperature adjustment knob 163 is provided rotatably on the control panel 13 (FIG. 1), while the temperature graduations (C°) for "100", "150", "200", and "250" are indicated on the operation portion 16 along the periphery of the knob 163. A variable resistor, to be described subsequently, is provided on the rear of the control panel 13 so as to be rotated by the above described knob 163. The timer operation knobs 162*a* and 162*b* are also provided so as to be rotatable, while graduations for indicating the position "0" and the intervals for five minutes are indicated along the periphery of the knobs. Although not shown, the timer operation knobs 162*a* and 162*b* are operatively coupled to signal generators 20*a* and 20*b* (FIG. 6). The CLOCK FAST key and the CLOCK SLOW key are used for setting a time period. The CLEAR key is used for clearing the set command information. The START key is used for commanding initiation of microwave generation by the magnetron 105. The input from the key matrix 221 coupled to these keys is applied to the key input terminals IK1 to IK4 as a key code signal. The microprocessor 201 is responsive to the key code signal applied to the terminals IK1 to IK4 to detect or identify which key is depressed.

Figure 4:
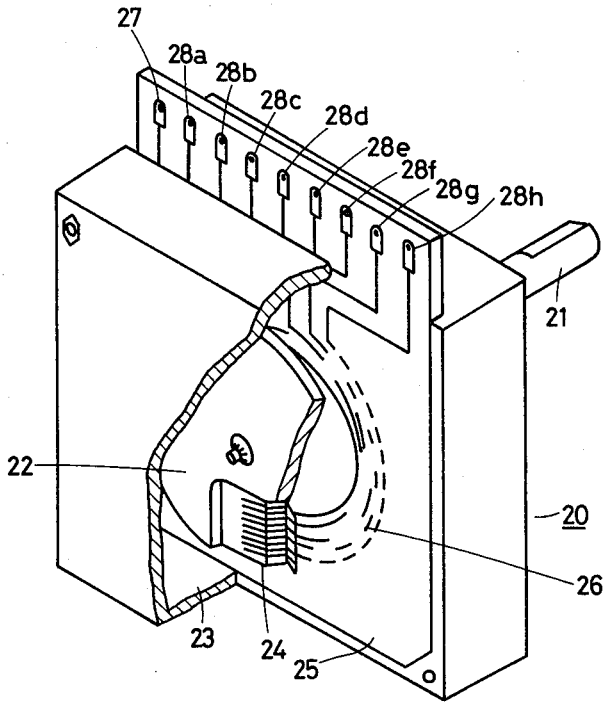
FIG. 4 is a fragmentary perspective view showing one example of a signal generator coupled in a ganged fashion with the operation knob.

FIG. 4 is a fragmentary perspective view of one example of the signal generator 20*a*. The signal generator 20 is provided on the rear surface of the control panel 13, so that the same is operatively coupled in a ganged fashion to the above described timer operation knob 162*a*. The signal generator 20*a* comprises an operation shaft 21 extending through the operation panel 13 to the front surface thereof and the operation shaft 21 is fitted to a hole, not shown, formed at the center of the rear surface of the timer operation knob 162*a*. Accordingly, the operation shaft 21 is rotated through rotation of the operation knob 162*a*. The other end of the operation shaft 21 extends through a print circuit board 25. A rotation plate 22 is fixed to the other end so as to be integrally rotatable with the operation shaft 21. A common base portion of the conductive brush 24 is fixed to the rotation plate 22. Accordingly, when the operation shaft 21 is rotated by the knob 162*a*, the tip end of the brush 24 slides on the surface of the print circuit board 25. The print circuit board 25 is formed of a conductive pattern 26 along the sliding path of the brush 24. The conductive pattern 26 comprises nine conductive runs to be described subsequently. One of the nine conductive runs is connected to the common terminal 27, while the remaining eight conductive runs are connected to the corresponding first to eighth signal terminals 28*a* to 28*h*, respectively. The conductive pattern 26, the brush 24 and the rotation plate 22 are housed within a casing 22 constituting the signal generator 20*a*.

Figure 5B:
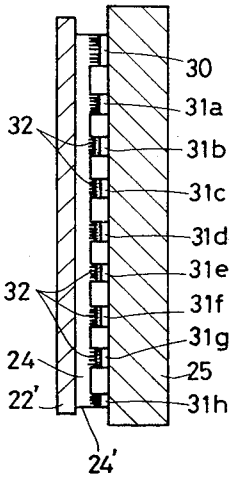
FIGS. 5A and 5B are views for explaining the FIG. 4 signal generator.
Figure 5A:
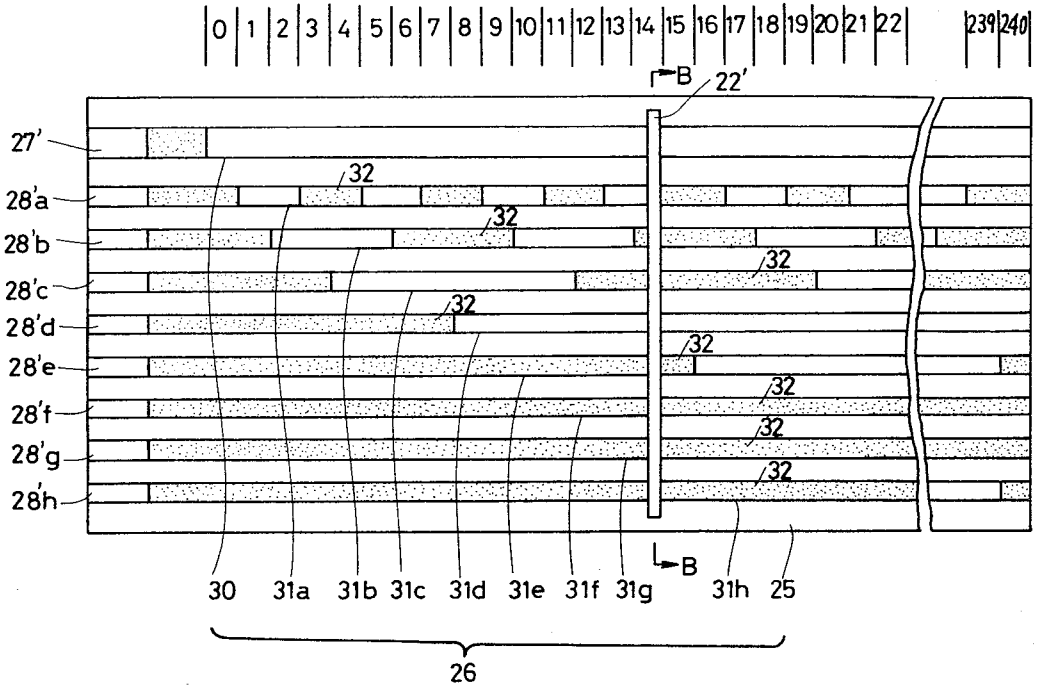

FIG. 5A is a view showing the above described conductive pattern 26 developed in a linear manner and FIG. 5B is a view showing a relation of the conductive pattern 26, the rotation plate 22 and the brush 24. Referring to FIG. 5A, the conductive pattern 26 formed on the surface of the print circuit board 25 comprises one common run 30, and the first to eighth signal runs 31*a* to 31*h*, these common run and the signal runs being formed to extend in parallel. It would be appreciated that the movement of the brush 24 shown in FIG. 4 is equivalent to the movement along the extension direction of the conductive pattern 26 in FIG. 5A of the brush 24' extending perpendicular to the extension direction of the conductive pattern 26 in sliding contact with the common run 30 and the respective signal runs 31*a* to 31*h*.

The conductive pattern 26 is divided equispaced at the positions (unit portion) of 0 to 240. The position 0 is determined as the position of the brush 24' corresponding to the origin position of the operation knob 162*a* (FIG. 3) and the position 240 is determined as the position of the brush 24' corresponding to the position of sixty minutes of the operation knob 162*a*. Meanwhile, referring to FIG. 5A, the reference numeral 27′ corresponds to the common terminal 27 in FIG. 4, and the reference numerals 28′*a* to 28′*h* correspond to the signal terminals 28*a* to 28*h* in FIG. 4, respectively. Referring to FIG. 5A, the portions as dotted on the respective conductive runs denote a portion where the insulating film 32 has been formed, where no electrical connection is established between the run and the brush even if the brush 24′ is positioned. As understood from FIG. 5A, the common run 30 has been formed such that the conductive surface may be exposed in the full range from the position (unit portion) 0 up to the position 240. The first signal run 31*a* is formed such that the conductive surface may be exposed at the respective positions of "$A_1+4M_1$"th, where $A_1=1$, 2 and $M_1=0$ to 59. The second signal run 31*b* is formed such that the conductive surface may be exposed at the respective positions represented as the "$A_2+8M_2$"th, where $A_2=2$ to 5 and $M_2=2$ to 29. The third signal run 31*c* is formed such that the conductive surface may be exposed at the respective positions represented as the "$A_3+16M_3$"th, where $A_3=4$ to 11 and $M_3=0$ to 14. The fourth signal run 31*d* is formed such that the conductive surface may be exposed at the respective positions represented as the "$A_4+32M_4$"th, where $A_4=8$ to 23 and $M_4=0$ to 7. The fifth signal run 31*e* is formed such that the conductive surface may be exposed at the respective positions represented as the "$A_5+64M_5$"th, where $A_5=16$ and 47 and $M_5=0$ to 3. The sixth signal run 31*f* is formed such that the conductive surface may be exposed at the respective positions as represented as the "$A_6+128M_6$"th, where $A_6=32$ to 95 and $M_6=0$ or 1. The seventh signal run 31*g* is formed such that the conductive surface may be exposed at the respective positions as represented as the "$A_7$"th, where $A_7=64$ to 191. The eighth signal run 31*h* is formed such that the conductive surface may be exposed at the respective positions as represented as the "$A_8$"th, where $A_8=128$ to 239.

The signal generator 20*a* generates a code signal corresponding to an operated amount or a displaced amount of the timer operation knob 162*a* (FIG. 3). Consider a case where the brush 24′ is at the fourteenth position, for example, as shown in FIG. 5A. One pulse is applied from the output terminal OD6 of the microprocessor 201 (FIG. 6) to the common terminal 27′. Then, the pulse signal is applied through the common terminal 27′ and the common run 30 and through the brush 24′ to the respective signal runs 28′*a* to 28′*h*. However, as far as the fourteenth position is concerned, only the first and fourth signal runs 31*a* and 31*d* have been formed such that the conductive surface may be exposed at that position. Accordingly, the above described pulse signal appears only at the first and fourth signal terminals 28′*a* and 28′*d* corresponding to the above described signal runs 31*a* and 31*d*. Accordingly, assuming that the presence or absence of the above described pulse signal corresponds to the logic one or zero, then the signal generation state at the respective signal terminals 28′*a* to 28′*h* corresponding to the respective signal runs 31*a* to 31*h* becomes "10010000". Likewise, the signal generation state at the other positions may be listed as shown in the following table.

TABLE

| Position | Signal Generation State | |
|---|---|---|
| 0 | 0000 | 0000 |

TABLE-continued

| Position | Signal Generation State | |
|---|---|---|
| 1 | 1000 | 0000 |
| 2 | 1100 | 0000 |
| 3 | 0100 | 0000 |
| 4 | 0110 | 0000 |
| 5 | 1110 | 0000 |
| . | . | . |
| . | . | . |
| . | . | . |

As apparent from the above described table, by displacing the operation knob 162*a*, a code signal of eight bits corresponding to the position of the brush 24′ corresponding to the displacement is obtained. It is noted that a signal corresponding to the adjacent position contains only a variation of one bit. Such a code signal including a variation on a one bit by one bit basis is known as the so-called Gray code or the reflected binary code. The fact that the code signal obtained from the signal generator 20*a* is represented by the Gray code means that even in a state of the brush 24′ at the boarder of two adjacent positions the resultant code signal in such a situation comes to correspond to either of the two adjacent positions. Accordingly, even in such a situation, a code signal corresponding to either position is obtained, whereby any malfunction is avoided in such a critical position.

Meanwhile, another signal generator 20*b* (FIG. 6) may also be structured in the same manner and the same may be operated in the same manner by means of a timer operation knob 162*b*.

The embodiment shown is further structured such that the input terminals IT1 to IT8 of the microprocessor 201 commonly receive the outputs of 8 bits obtained from two signal generators 20*a* and 20*b*. The microprocessor 201 comprises an output terminal OD6 for providing a pulse signal to the signal generator 20*a* and an output terminal OD7 for providing a pulse signal to the other signal generator 20*b*. The code signal of eight bits can assume 241 different combinations corresponding to 241 different positions. Accordingly, assuming that the portion of the conductive pattern 26 corresponding to the range of 0 to 60 minutes indicated on the periphery of the operation knob 19 is divided into 240 equispaced minor unit portions, then one minor unit portion corresponds to fifteen seconds, with the result that a different code signal is obtained for every fifteen seconds in setting a timer period by the knob 19.

Figure 2:
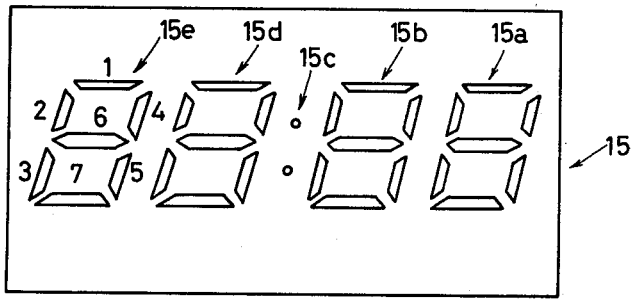
FIG. 2 is a view showing one example of a display.

The display 15 is structured as shown in FIG. 2, for example, by means of a fluorescent type display tube. More specifically, the display 15 comprises a numerical value display portion. The numerical value display portion comprises four numeral display portions 15*a*, 15*b*, 15*d* and 15*e*, each including an "8" shaped segment arrangement, and a colon display portion 15*c* formed between the numeral display portions 15*b* and 15*d*. The output signal obtained from the output terminals ODG1 to ODG5 of the microprocessor 201 functions as a digit selecting signal of the respective display digits 15*a* to 15*e*. On the other hand, the output signal obtained from the output terminals ODS1 to ODS7 functions as a segment selecting signal corresponding to the respective segments in each of the numeral display portions. Accordingly, if and when a signal is obtained from the output terminal ODG2, for example, and the output signal is obtained at the terminals ODS1, ODS3, ODS4, ODS6, and ODS7 a numeral "2" is displayed at the numeral display portion 15*b* is enabled to emit light. The output signal obtained from the output terminal ODS7 functions as a selection signal of the colon display portion 15*c*. Accordingly, if and when the output signal is obtained from the output terminal ODG5 and the output signal is obtained from the terminals ODS7, the colon display portion 15*c* is enabled to emit light. The display 15 makes a current time display and a timer period display, such that in case of the current time display the current time of say two o'clock thirty-five minute is displayed as "2:35" and in case of the timer period display the timer period of say thirty minute thirty second is displayed as "1330".

Returning to FIG. 6, the output terminal OB of the microprocessor 201 is a buzzer terminal. If and when an output terminal is obtained at the terminal OB, the transistor 205 coupled thereto is rendered conductive, whereby the buzzer 207 is driven to raise an alarm. The buzzer 207 is used to generate a confirmation alarm responsive to a key operation of the above described operation portion 16, completion of cooking, and the like. However, the buzzer 207 may also be used as one of alarming means to be described subsequently.

The input terminal IC1 of the microprocessor 201 is an input terminal for detecting an opened/closed state of the door 14 shown in FIG. 1. More specifically, a door switch 209 adapted to be turned on responsive to the door switch knob 18 (FIG. 1) is connected to the input terminal IC1. Accordingly, in the absence of the input signal at the terminal IC1, i.e. if and when the door switch 209 is turned off, the microprocessor 201 determines that the door 14 has been opened. In such a situation, the microprocessor 201 performs necessary operations such as interruption of its own operation, and the like.

The input terminal RESET is a terminal for initially resetting the microprocessor 201 upon turning on of a power supply to the microwave oven. More specifically, if and when the power supply is turned on, the rise of the source voltage $V_C$ obtained from the control voltage source 133 is detected by means of a detecting circuit 213 implemented by a transistor and a Zener diode. The output from the detecting circuit 213 is applied to the terminal RESET. Then the microprocessor 201 resets the respective portions to an initial condition.

An interrupt signal is applied to the input terminal INT of the microprocessor 201. More specifically, the time base signal obtained from the above described control voltage source 133 is an alternating current signal of say 60 Hz and is shaped into a pulse signal of say 60 Hz by means of a wave shaping circuit 219 comprising a transistor, a diode and a capacitor, whereupon the pulse signal is applied to the input terminal INT. Each time the pulse signal obtained from the wave shaping circuit 219 is applied to the input terminal INT, the microprocessor 201 interrupts any other processing, whereupon timing processing is performed. More specifically, the microprocessor 201 functions to generate a signal representing "second", a signal representing "minute", and a signal representing "hour" in synchronism with the above described pulse signal of 60 Hz.

The output terminals OM, OH and OT are a heat command terminal and an output level command terminal, respectively. In performing a heat processing operation using a magnetron 105 the microprocessor 201 just provides an output signal at the output terminal OM and then provides an output signal at the output terminal OT with a slight delay. Upon completion of execution of the heating operation, the output signals at the two terminals OM and OT are caused to disappear. If and when the output signal is obtained at the output terminal OP, the transistor 145 is rendered conductive and accordingly the relay 121 is energized. Accordingly, the normally closed contact 123*a* is turned off and the normally opened contact 125*a* is turned on. Accordingly, a short circuit state of the gate electrode 119 of the bidirectional thyristor 107 is released and the blower motor 121 is energized. When the output is obtained from the output terminal OM thereafter, the transistor 131 is rendered conductive and the photocoupler 117 becomes operative. Then the output signal at the output terminal OM is obtained for a time period associated with an output level being set within each cycle which is determined as 10 second, for example. Assuming that a microwave output generated by the magnetron 105 is selected to be the maximum level, for example, the output signal is obtained for full period of time in each cycle, and assuming that the microwave output is selected to be a 50% level, the output signal is obtained for five second, for example, within each cycle. Furthermore, a heating operation by the use of a heater 137 is controlled with the outputs from the output terminals OH and OT.

The microprocessor 201 further comprises two output terminals OLa and OLb. The output terminals OLa and OLb are used to indicate which one the display by the display 15 is related to, "BLOCK A" or "BLOCK B" in FIG. 13. More specifically, the output terminal OLa is connected to the base electrode of the transistor 231 for driving the display lamp 161*a* and the output terminal OLb is connected to the base electrode of the transistor 233 for driving the display lamp 161*b*. Accordingly, in the presence of the output from the output terminal OLa the display lamp 161*a* is lighted, whereby an indication is made to an operator that a display by the display 15 is related to the set time period by the timer operation knob 162*a* provided in the circle "BLOCK A". Similarly, the output is obtained from the output terminal OLb, when the display by the display portion 15 is related to the set time period by the timer operation knob 162*b* provided in the circle "BLOCK B".

The microprocessor 201 further comprises an input terminal IC2. The input terminal IC2 is allotted for a temperature detection input terminal on the occasion of a temperature operation. The input terminal IC2 is connected to receive the output of the comparator 223. One input of the comparator 223 is connected to receive a voltage from the junction of a thermistor 11 provided operatively coupled to the cooking chamber 12 and the resistor 225. The other input of the comparator 223 is connected to receive a voltage from the junction of a variable resistor 227 and a resistor 229. The thermistor 11 may be provided on the outside of the upper wall of the cooking chamber 12, as shown by the dotted line in FIG. 1. Alternatively, the thermistor 11 may be provided in the vicinity of an exhaust port, not shown, so that the temperature of the exhaust from the cooking chamber may be detected. The variable resistor 227 is provided so as to be rotated by the temperature adjustment knob 163 depicted in conjunction with FIG. 3, so that a resistance value thereof may be changed as a function of the rotation of the knob 163. The comparator 223 provides an output when the terminal voltage from the thermistor 11 exceeds the terminal voltage of the variable resistor 227 and the output of the comparator 223 is applied to the input terminal IC2. More specifically, the comparator 223 provides the output to the input terminal IC2, if and when the temperature in the cooking chamber detected by the thermistor 11 exceeds a temperature preset by the temperature adjustment knob 163.

Figures 7, 8:
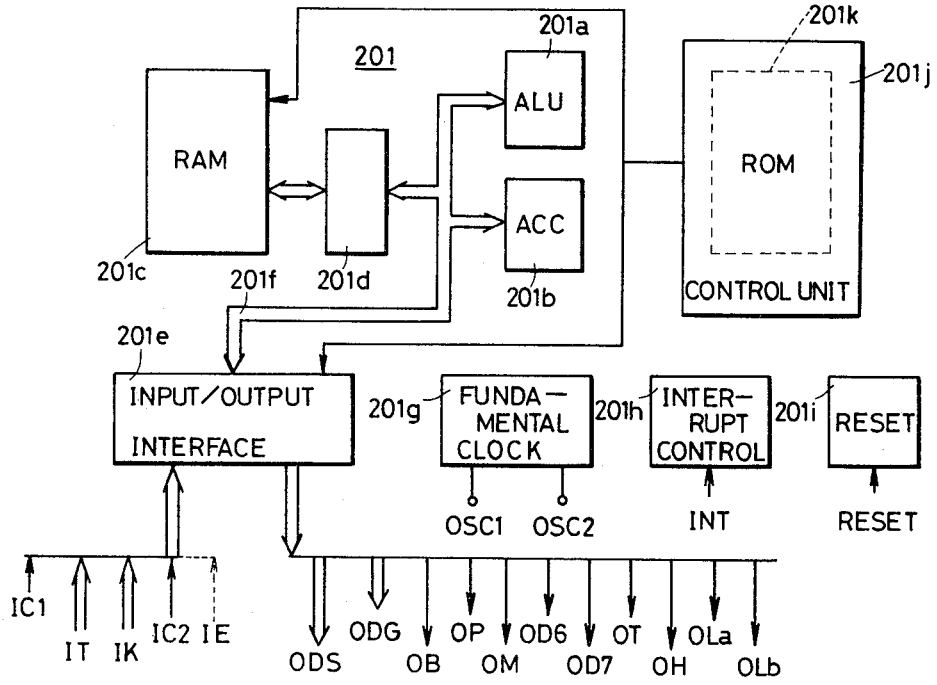
FIG. 7 is a block diagram showing a structure of a microprocessor.
FIG. 8 is a view showing the storing regions of a random access memory.

FIG. 7 is a block diagram of the microprocessor 201. The microprocessor 201 comprises an arithmetic logic unit 201*a*, an accumulator 201*b*, a random access memory 1*c*, a random access memory buffer 201*d*, an input-/output interface 201*e* and a control unit 201*j*. A data bus 201*f* is provided for communication of information between these blocks. The control unit 201*j* performs functions of controlling communication of information among these blocks. External input signals IC1, IC2, IT, IK1 to IK4 and external output signals ODS1 to ODS7, ODG1 to ODG5, OB, OM, OH, OT, OD6, OD7, OLa and OLb are inputted and outputted through the input-/output interface 201*e*.

The microprocessor 201 further comprises a reference clock signal generator 201*g*, an interrupt control unit 201*h* and a reset unit 201*i*. The reference signal generator 201*g* cooperates with an external component 203 shown in FIG. 6 to generate a reference clock signal of 400 kHz, for example. The interrupt control unit 201*h* is responsive to the interrupt signal INT obtained from a wave shaping circuit 219 to command an interrupt operation for the purpose of a required timing operation. The reset unit 201*i* is responsive to the reset signal RESET to command a required reset operation.

The control unit 201*j* comprises a read only memory 201*k*. The read only memory 201*k* contains a system program and a programmable counter, not shown, to be described subsequently.

The random access memory 201*c* of the embodiment shown comprises the DISPLAY region, the CLOCK region, the TIME1 region and the TIME2 region each of the 4-digit length, as shown in FIG. 8. The random access memory 201*c* further comprises the NT region, OT1 region and the OT2 region each of the 2-digit length. The random access memory 201*c* comprises the FKB region and the COUNT region of the 1-digit length. In the embodiment shown the FLG region comprises the regions FLG1 to FLG13 each of one bit. The TIME1 region and the TIME2 region are used to store timer time periods associated with the timer operation knobs 162*a* and 162*b*, respectively. These regions of the 4-digit length are used as output buffers to the display 15. The FLG1 region serves to indicate whether there occurs a change in the position of the timer operation knob 162*a* or 162*b*. The FLG2 region serves to indicate whether a current time display has been made by the display 15. The FLG3 region serves to indicate whether any key operation has been made in the operation portion 16. The FLG4 region serves to indicate whether any one of the "MICROWAVE STRONG" key and the "MICROWAVE WEAK(A)" key has been operated. The FLG5 region serves to indicate whether any one of the "MICROWAVE WEAK(B)" key and "HEATER" key has been operated. The FLG6 region serves to indicate which one of the timer operation knobs 162*a* and 162*b* the timer time period as loaded is. The FLG7 region serves to indicate which one of the keys in the "BLOCK A" and the "BLOCK B" of the operation portion 16 has been operated. The FLG8 region serves to indicate which block key of the "BLOCK A" and "BLOCK B" has been previously operated. The FLG9 region serves to indicate whether any one of the keys in the circles "BLOCK A" and "BLOCK B" has been operated. The FLG10 region serves to indicate whether a heat operation has been performed by means of the magnetron 105 or the heater 137. The FLG11 region serves to indicate whether door 14 (FIG. 1) has been opened in the course of the heat operation.

The FLG12 region and the FLG13 region store the information as to whether it is within a predetermined period of time after the timer operation knobs 162*a* and 162*b* are displaced, respectively.

Now that a structure of a preferred embodiment of the present invention was described in the foregoing, a control operation by the microprocessor 201 will be described in detail in the following.

STANDBY STATE

As far as the microwave oven is in an enabled state, the microprocessor 201 is responsive to the input signal at the input terminal INT to perform a timing operation as described previously irrespective of a key operation by the operation portion 16 and the current time is renewed by a current time storing region which is an accessible region included in the random access memory of the microprocessor 201. Now assuming that no key operation is made by the operation portion 16 and therefore the microwave oven is in a standby state, then the current time is normally displayed by the display 15.

Now that the structural features of the embodiment shown were described in the foregoing, an operation of the embodiment shown will be described with reference to the flow diagram shown in FIGS. 9A to 9H.

Referring to FIGS. 9A to 9H, the rectangle blocks and the rhombus blocks show the respective steps constituting the program, wherein the numbers allotted to the respective blocks indicate the step numbers. In principle, the program proceeds from the block of a smaller step number to a block of a larger step number in the order of arrangement of the respective blocks, except that the program suitably returns to the previous step on the occasion of the return or depending on the decision by the respective determining steps.

Generally out of the steps shown by the rectangle blocks, the steps as indicated as "FLGn←0" and "FLGn←1" (where n=1 to 13) show that the logics zero and one are loaded in the FLGn regions, and out of the steps indicated in the rhombus blocks, the steps indicated as "FLGn=1?" (where n=1 to 13) show that the content in the FLGn region is determined and the content is determined as YES when the same is the logic one whereas the same is determined as NO when the same is the logic zero.

Now in the following the remaining steps will be described.

Step S301: The step is automatically executed responsive to the input signal to the terminal RESET of the microprocessor on the occasion of turning on of a power supply to the microwave oven and the clock associated region including the CLOCK region of the random access memory is cleared.

Step S302: All the output terminal signals of the microprocessor and all the other regions of the random access memory excluding the above described clock associated regions are cleared.

Steps S303 and S321: The output is obtained from the output terminal OD6 of the microprocessor and accordingly the signal of 8 bits is obtained from the signal generator 20*a* depending on the position of the timer operation knob 162*a* at that time and is applied to the input terminal IT1 to IT8 of the microprocessor.

Steps S304, S312, S322 and S345: The signals being applied to the input terminals IT1 to IT8 of the microprocessor are as such stored in the NT region.

Steps S305 and S323: The output of the output terminal OD6 of the microprocessor is reset to disappear.

Steps S306, S335 and S367: The content in the NT region is transferred to the OT1 region, while the content in the NT region is held even after the above described transfer.

Steps S307, S315, S336 and S352: The content in the NT region undergoes code conversion, whereby the original Gray code of 8-bits is converted into a binary code of 8-bits. The above described code conversions at the respective steps can be made by the well-known logical operation, although in the embodiment shown a specific simple approach was employed. More specifically, the Gray code is converted into the binary code by using an arithmetic logical unit. Such code conversion is performed by detecting the presence or absence of the logic one in succession from the more significant bit to the less significant bit of the Gray code and by continuing an inverting operation of the content in the bit less significant than the bit of the odd ordinal number until the following bit of the logic one.

Steps S308 and S337: The content in the NT region is converted from the binary code further to the binary coded decimal code of 4 digits, whereupon the code is stored in the TIME1 region, such conversion being performed through a well-known logical operation.

Steps S309 and S338: The numerical value loaded in the TIME1 region at the steps S308 and S337 coincide with the number of the unit minor graduation (FIG. 5A) counted from the origin point of the timer operation knob 162*a*. Since the unit minor graduation corresponds to 15 seconds, the content in the TIME1 region is multiplied by 15 at the following steps S309 and S338. As a result, the content in the TIME1 region becomes a value of a timer time period indicated in terms of second and corresponding to the position of the timer operation knob 162*a*. For example, assuming that the operation knob 162*a* is at the position of five minutes thirty seconds, the content in the TIME1 region becomes "0330".

Steps S310 and S339: The content in the TIME1 region represented in terms of second at the previous steps S309 and S338 is converted to the value in terms of the minute and second unit. More specifically, in the case of the above described example, "0330" is converted into "0530".

Steps S311 and S344: The output is obtained at the output terminal OD7 of the microprocessor. Accordingly, the signal of 8-bits corresponding to the position of the timer operation knob 162*b* is obtained from the signal generator 20*b* and is applied to the input terminal IT1 to IT8 of the microprocessor.

Steps S313 and S346: The output of the output terminal OD7 of the microprocessor is reset to diappear.

Steps S314, S351 and S366: The content in the NT region is transferred to the OT2 region. The content in the NT region is held even after the above described transfer.

Steps S316 and S353: As in the case of the previous steps S308 and S337, the content in the NT region is converted from the binary code of 8-bits to the binary coded decimal code of 4-digits and is loaded in the TIME2 region.

Steps S317 and S354: As in the case of the previous steps S309 and S338, the timer time period information concerning the timer operation knob 162*b* is converted to the value in terms of a second unit and is loaded in the TIME2 region.

Steps S318 and S355: As in the case of the previous steps S310 and S339, the content in the TIME2 region is converted into the value in terms of the minute and second units.

Step S319: The content in the CLOCK region is transferred to the DISPLAY region. After such transfer the content in the CLOCK region is maintained.

Step S324: It is determined whether the respective contents in the NT region and the OT1 region are equal to each other.

Step S326: It is determined whether the value obtained by adding or subtracting the code corresponding to the numerical value 1 to or from the content in the NT region is equal to the content in the OT1 region. Meanwhile, the determination made at the step S326 can be made with more ease by making such code conversion as at the step S336 immediately after step S323.

Step S327-3: The numerical value 5 at the second unit is loaded in the COUNT region.

Step S327-7: The content in the COUNT region is subtracted for each second. More specifically, the program passes through the step S327-7 at the rate of a number of times per each second and the numerical value 1 is subtracted from the COUNT region for each pass at each second.

Step S327-8: It is determined whether the content in the COUNT region has become 0.

Step S328: A display is made by the display 15 and the same time key operation by the operation portion 16 is detected. More specifically, the outputs are in succession obtained at the input/output control terminals ODG1 to ODG5. At the same time, the contents of the respective digits of the DISPLAY region undergo code conversion in synchronism with the outputs obtained at these terminals ODG1 to ODG4 and the converted outputs are obtained from the display output terminals ODS1 to ODS7. At that time unnecessary zeros in the more significant digits are suppressed from being displayed. The content in the FLG2 region is determined and if the same is determined as the logic zero the output is obtained at the terminal ODG7 in synchronism with the output of the control terminal ODG5 for the purpose of displaying the current time, whereby a colon display is made by the display 15. On the other hand, in the case where key operation is made by the operation portion 16, the key operation is detected through the key signal input terminals IK1 to IK4 and the code corresponding to the said key is stored in the FKB region, while the logic one is loaded in the FLG3 region, whereby the fact of the key operation is stored.

Steps S340 and S427: The content in the TIME1 region is transferred to the DISPLAY region. Even after the above described transfer the content in the TIME1 region is maintained.

Steps S341 and S428: The outputs at the output terminals OLb and OLa of the microprocessor are set to be off and on, respectively.

Step S347: It is determined whether the respective contents in the NT region and the OT2 region are equal to each other.

Step S349: It is determined whether the value obtained by adding or subtracting the code corresponding to the numerical value 1 to or from the content in the NT region is equal to the content in the OT2 region. Meanwhile, the determination made at the step S349 can be made with more ease by making such code conversion as at the step S352 immediately after the step S346.

Steps S356 and S425: The content in the TIME2 region is transferred to the DISPLAY region. Even after the above described transfer the content in the TIME2 region is maintained.

Steps S357 and S426: The outputs of the output terminals OLa and OLb of the microprocessor are set to be off and on, respectively.

Steps S360, S401 and S537: An opened/closed state of the door 14 is checked through the input terminal IC1 of the microprocessor.

Step S362: The content in the FKB region is checked, whereby it is determined whether the same corresponds to the START key or not.

Steps S404 and S429: All the outputs at the output terminals OM, OH and OT of the microprocessor are turned off.

Steps S407 and S416: The output is generated with a 30% duty at the output terminal OM of the microprocessor. More specifically, on the occasion of a heat operation by a microwave, the program passes the steps S407 and S416 at the rate of a number of times per second, as will become apparent from the following description. On the occasion of the first passage of the steps S407 and S416, the output of the output terminal OM is turned on and on the occasion of the passage of the above described steps after the lapse of three seconds the output of the output terminal OM is turned off, whereupon on the occasion of the passage of the above described steps after the lapse of seven seconds thereafter again the output of the output terminal OM is turned on, whereupon the above described process is repeated. On the occasion of a heat operation the output is also obtained at the output terminal OT and the above described steps S407 and S416 are repeated, whereby the magnetron 105 makes oscillation with the cycle of 10 seconds, and for three seconds for each cycle. The oscillation output on that occasion is determined to be 180 W.

Step S408: The presence or absence of the input to the input terminal IC2 of the microprocessor is checked and in the presence of the input the output terminal OH is turned off, whereas in the absence of the input the output at the output terminal OH is turned on.

Step S409: The content of the TIME2 region is subtracted for every second. More specifically, as in the case of the previous step S407, on the occasion of a heat operation, the program passes the step S409 at the rate of a number of times per second, while the above described subtracting operation is made for each passage of one second.

Step S410: It is determined whether the content in the TIME2 region has become zero or not.

Step S411: The output of the output terminal OLb of the microprocessor is turned off.

Step S417: The output of the output terminal OM of the microprocessor is turned on.

Step S418: As in the case of the previous step S409, the content in the TIME1 region is subtracted for each second.

Step S419: It is determined whether the TIME1 region is zero.

Step S420: The output of the output terminal OLa of the microprocessor is turned off.

Step S430: The output is obtained for one second at the output terminal OB of the microprocessor, whereupon the program proceeds to the step S302.

Steps S502, S504 to S508 and S510: The content in the FKB region is checked at these steps to determine whether the same corresponds to any one of the CLEAR key, the START key, the MICROWAVE STRONG key, the MICROWAVE WEAK(A) key, the MICROWAVE WEAK(B) key, HEATER key, and the CLOCK FAST key. In the case where the same does not correspond to any one of them, the program determines the same as the CLOCK SLOW key and proceeds to the step S511.

Step S511 and S512: At these steps the content in the CLOCK region changes at the speed quicker than the normal speed. More specifically, since the least significant digit of the content of the CLOCK region is the minute unit, normally the content is renewed for every minute; however, at the step S511 the renewal is made for each second and at the step S512 renewal is made for every 0.5 second.

Step S559: The output of the output terminal OT of the microprocessor is turned on.

In the following a control operation of the microprocessor will be described in more detail.

[I] Initiation of Power Supply and Current Time Setting

Upon initiation of a power supply to the microwave oven, the program proceeds through the steps S301 to S323 to the step S324. At that time the timer time period loaded at the stpes S306 and S322 remains the same unless the timer operation knob 162*a* is turned. Accordingly, the program proceeds after the step S324 through the steps S327-5 to S327-7 to the step S327-8. In such a case, since the content in the COUNT region is originally the numerical value of 0, the program proceeds after the step S327-8 through the steps S327-9, S327-10 and S328 to S330 to the step S331. Now assuming that no key operation is made by the operation portion 16, the program proceeds from the step S331 through the steps S332 and S333 to return to the step S319. The program further proceeds to the step S320. Since the content in the FLG6 region has become the logic one at that time through the step S327-5, the program then proceeds through the steps S344 to S347 to the step S348. The timer time period loaded at the steps S314 and S345 remains the same unless the timer operation knob 162*b* is turned. Accordingly, the program proceeds after the step S347 through the steps S350-1, S327-6 and S327-7 to return to the step S328. Since the content in the COUNT region is the numerical value of 0 in such case as well, the program proceeds after the step S327-8 through the steps S327-9, and S327-10 to return to the step S328. Accordingly, likewise thereafter within one second after initiation of the power supply the program makes alternate circulations of the first group including the steps S319 to S324, S327-5 to S327-10, S328 to S333 and the second loop including the steps S319, S320, S344 to S347, S350-1, S327-6 to S327-10, S328 to S333. After the lapse of one second since initiation of the power supply, at the step S327-7 in the above described first or second loop, the content in the COUNT region becomes the value which is the numerical value of 0 minus the numerical value of 1 (since the COUNT region is of 4 bits, the value which is the numerical value of 0 minus the numerical value of 1 is the numerical value of 15). Therefore, the program proceeds from the step S327-8 directly to the step S328, with a portion of the process in the first or second loop modified. In the above described subtraction process, insofar as the content in the COUNT region is any value among the numerical value of 15 to the numerical value of 1, the program makes circulation of the first or second loop, as modified as described previously. Meanwhile, since the contents in the FLG12 region and the FLG13 region are the logic zero at the beginning, the program making circulation of either the first or the second loop has no meaning in these FLG12 region and the FLG13 region. In the course of the above described circulations, the content in the CLOCK region is transferred to the DISPLAY region at the step S319 and is displayed by the display 15 at the step S328. Although the content displayed is a current time display, the displayed current time is incorrect, since the current time setting has not been made at that time.

When the CLOCK FAST key or the CLOCK SLOW key is depressed for the purpose of setting the current time, the key operation is detected at the step S331 in the above described circulation process. Thereafter the program proceeds from the step S331 to the step S501, whereupon the program proceeds through the steps S502 to S510 and further through the step S511 or S512 to return to the step S319. Accordingly, insofar as the CLOCK FAST key or the CLOCK SLOW key is kept depressed, the program makes circulation of the steps S319 to S324, S327-5 (or S319, S320, S344 to S347, S350-1) and S327-6 to S327-8 (or S327-6 to S327-10), S328 to S331, S501 to S510 and S511 or S512, whereby a displayed current time in the display 15 quickly changes during that time period.

At the time point when the displayed current time reaches a correct current time, the above described key is released from being depressed, whereupon the program again makes circulation of the above described first loop or the second loop, while the correct current time is displayed by the display 15. Such state is a standby state.

[II] Microwave Strong Heat Operation→Microwave Weak Heat Operation

Consider a case where a heat cooking operation is performed for 25 minutes with a microwave of a strong output (600 W) and then a heat cooking operation is performed for 40 minutes with a microwave of a weak output (180 W). In such a case, first of all the timer operation knobs **162*a* and 162*b* are set to the graduation positions of 25 minutes and 40 minutes, respectively, in the operation portion 16**.

Assuming that the timer operation knob **162*a* is first operated, then such timer operation is detected at the step S324 in the above described standby state and the program then proceeds to S326. Since the content in the FLG12 region is the logic zero at that time, the program proceeds after the step S325 to the step S326. If and when the displacement of the brush 24' is two or more positions, (see FIG. 5A) through an operation of the above described timer operation knob 162*a*, the program proceeds after the step S326 through the steps S327-1 to S327-4, S328 to S332, S334, S335, S337 to S343. Thereafter the program returns to the step S320 and proceeds again through the steps S321 to S323 to return to the step S324. If the timer operation knob 162*a* is operated at that time, the program proceeds to the step S325. Since the logic one has been loaded in the FLG12 region at the previous step S327-2 in such a case, the program then proceeds through the steps S327-1 to S327-4, S328 to S332, S334, S335 to S343. Thereafter the timer operation knob 162*a* is operated until a desired time period, i.e. 25 minutes is set, and during that time period the program makes circulation of the steps S320 to S324, S325, S327-1 to S327-4, S328 to S332, S334, S335 to S343. More specifically, the timer time period information during a time period when the timer operation knob 162*a* is operated and the desired timer time period information "25 minutes" are loaded in the TIME1 region at the step S339 and transferred to the DISPLAY region at the step S340 and only the display lamp 161*a* is lighted at the step S341**.

The program then makes alternate circulations of the third group including the steps S320 to S324, S327-5 to S327-8, S328 to S333 and the fourth loop including the steps S320, S344 to S347, S350-1, S327-6 to S327-8, S328 to S333. At the step S327-3 of the above described circulation process, the numerical value 5 stored in the COUNT region is subtracted for each second at the step S327-7. Then after the lapse of 5 seconds, i.e. when the content in the COUNT region becomes the numerical value of 0, the third and fourth loops are partially modified and the program proceeds after the step S327-8 through the steps S327-9 and S327-10 to the step S328. In other words, the FLG12 region is reset at that time. Thereafter the program makes circulations of the above described loops depending on the subtraction result at the step S327-7, while the timer time period information of 25 minutes is displayed at the step S328. Since the display lamp **161*a* is lighted at that time, it is notified that the displayed content, i.e. 25 minutes, in the display portion 15 is the time period information associated with the timer operation knob 162*a***.

Then the timer operation knob **162*b* is operated. The operation of the timer operation knob 162*b* may be within 5 seconds after the above described timer operation knob 162*a*** is operated.

The operation of the above described timer operation knob **162*b* is detected at the step S347 in the above described circulation process of the fourth loop (or the modified fourth loop) and then the program proceeds to the step S348. Since the content in the FLG13 region is the logic zero at that time, the program proceeds after the step S348 to the step S349. If and when the displacement of the brush 24' (see FIG. 5A) by virtue of the operation of the timer operation knob 162*b* is by two or more two positions, then the program proceeds after the step S349 through the steps S350-2, S350-3, S327-3, S327-4, S328 to S332, S334, S351, S353 to S358, S343. Then the program returns to the step S320 and again proceeds through the steps S344 to S346 to the step S347. When the operation of the timer operation knob 162*b* is ended at that time, the program proceeds to the following step S348. Since in such a case the FLG13 region has been loaded with the logic one at the previous step S350-3, the program then proceeds through the steps S350-2, S350-3, S327-3, S327-4, S328 to S332, S334, S351 to S358, and S343. The timer operation knob 162*b* is thereafter operated until the desired time period, i.e. 40 minutes is set. During that time period the program makes circulation of the steps S320, S344, S348, S350-2, S350-3, S327-3, S327-4, S328 to S332, S334, S351 to S358, and S343. More specifically, the timer time period information during the operation of the timer operation knob 162*b* and the desired timer time period information "40 minutes" are loaded in the TIME2 region at the step S355 and the same is transferred to the DISPLAY region at the step S356. Then only the display lamp 162*b* is lighted at the step S357**.

The program thereafter makes alternate circulations of the fourth and third loops and thereafter, as in the case of the end of operation of the timer operation knob 162*a*, the program makes circulation of the above described third and fourth loops, as modified, whereupon the FLG13 region is reset. The timer time period information of "40 minutes" is similarly displayed by the display 15 and the display lamp 161*b* is lighted, whereby it is notified that the displayed content in the display 15 contains the time period information associated with the timer operation knob 162*b*.

As for the order of operation of the timer operation knobs 162*a* and 162*b*, either may be earlier operated and the time period information designated by the knobs 162*a* and 162*b* is loaded in the respective TIME1 and TIME2 regions. The time period information of the last operated knob is displayed by the display 15 and the display lamp 161*a* or 161*b* is lighted, whereby it is indicated which knob the displayed content in the display 15 corresponds to.

Then the MICROWAVE STRONG key, the MICROWAVE WEAK(B) key, and the START key are operated in succession. Meanwhile, the operation of the MICROWAVE STRONG key may be within 5 seconds after the timer operation knob 162*b* is operated.

The key operation of the MICROWAVE STRONG key is detected at the step S331 in the above described circulations of the third and fourth loops or the modified third and fourth loops. Then the program proceeds through the steps S501 to S505, S513 S515 to S517, S340 to S343, while the key operation of the MICROWAVE STRONG key is loaded at the step S513. The key operation of any one of the keys in the circle indicated as "BLOCK A" in the operation portion 16 is stored at the step S517. The content of the TIME1 region is transferred to the DISPLAY region at the step S340 and only the display lamp 161*a* is lighted at the step S341. Insofar as the MICROWAVE STRONG key is kept operated, the program makes alternately circulations of the loop including the steps S320, S344 to S347, S350-1, S327-6 to S327-8 (or S320, S344 to S347, S350-1, S327-6 to S327-10), S328 to S331, S501 to S505, S513, S515, S516, S518, S340 to S343 and the loop including the step S320 to S324, S327-5 to S327-8 (or S320 to S324, S327-5 to S327-10), S328 to S331, S501 to S505, S513, S515, S516, S518, S340 to S343. When the above described key operation is released, the program makes alternately circulations of the fourth loop including the steps S320 to S326, S328 to S333 and the third loop including the steps S320, S344, to S349, S328 to S333. During the above described circulation processes, the time period information designated by the timer operation knob 162*a* is displayed by the display 15 and the display lamp 161*a* is lighted.

The following key operation of the MICROWAVE WEAK(B) key is detected at the step S331 in the course of the above described circulation processes of the third and fourth loops or the modified third and fourth loops. Then the program proceeds through the steps S501 to S507, S523, S525 to S528, S356 to S358, S343, while the key operation of the MICROWAVE WEAK(B) key is stored at the step S523. The key operation of any keys in the circles indicated as "BLOCK A" and "BLOCK B" of the operation portion 16 is stored at the step S528. At the step S356 the content in the TIME2 region is transferred to the display region and at the step S357 only the display lamp 161*a* is lighted. Insofar as the MICROWAVE WEAK(B) key is kept operated, the program makes alternately circulations of the loop including the steps S320 to S324, S327-5 to S327-8 (or S320 to S324, S327-5 to S327-10), S328 to S331, S501 to S507, S523, S525, S356 to S358, S343 and the loop including the steps S320, S344 to S347, S350-1, S327-6 to S327-8 (or S320, S344 to S347, S350-1, S327-6 to S327-10), S328 to S331, S501 to S507, S523, S525, S356 to S358, S343. When the above described key operation is released, the program makes alternately circulation of the third and fourth loop. In the course of the above described circulation processes, the time period information designated by the timer operation knob 162*b* is displayed and the display lamp 161*b* is lighted.

The content in the FLG8 region remains the logic zero depending on the order of operation of the above described MICROWAVE STRONG key and the MICROWAVE WEAK(B) key. This means that the key in the circle indicated as "BLOCK A" of the operation portion 16 is operated prior to the operation of the key in the circle indicated as "BLOCK B".

The final operation of the START key is detected at the step S331 in the above described circulation processes of the third and fourth loops and the program then proceeds through the steps S501 to S504, S537 to S540. At that time, the transistor 145 (FIG. 6) is turned on at the step S539. The program then proceeds through the steps S320 to S324, S327-5 (or S320, S344 to S347, S350-1), S327-6 to S327-8 (or S327-6 to S327-10), S328 to S330, S401, S405, S415, S417 to S419, S424, S427, S428, S331. The transistor 131 is turned on at the step S417 and accordingly oscillation of the magnetron 105 is started.

Insofar as the START key is kept operated, the program proceeds after the step S331 to the step S501, whereupon the program proceeds through the steps S502, S503 to the step S332 and then returns from the step S333 to the step S320.

When the above described key operation is released the program proceeds after the step S331 through the steps S332, S333 to return to the step S320. Thereafter, the program makes alternately circulations of the loop including the steps S320, S344 to S347, S350-1, S327-6 to S327-8 (or S320, S344 to S347, S350-1, S327-6 to S327-10), S328 to S330, S401, S405, S415, S417 to S419, S424, S427, S428, S331 to S333 and the loop including the steps S320 to S324, S327-5 to S327-8 (or S320 to S324, S327-5 to S327-10), S328 to S330, S401, S405, S415, S417 to S419, S424, S427, S428, S331 to S333. At the step S418 the content in the TIME1 region is subtracted for each second and the content thereof is transferred to the DISPLAY region at the step S427, whereby the same is displayed at the step S328 as the timer left time period. The program proceeds through the step S428, when the display lamp 161*a* is lighted, whereby it is indicated that the displayed content in the display 15 relates to the timer operation knob 162*a*. Since the transistors 145 and 131 are kept on during that period, the magnetron 105 is enabled to make continuous oscillation, i.e. with 100% duty, thereby to provide a microwave of 600 W.

If and when the timer time period of "25 minutes" passes, so that the timer left time period becomes zero during the above described circulation processes, the same is detected at the step S419 and the program proceeds through the steps S420 to S426, S331 to S333, S320 to S324, S327-5 (or S320, S344 to S347, S350-1), S327-6 to S327-8 (or S327-6 to S327-10), S328 to S330, S401, S405 to the step S406. More specifically, this means that a microwave strong heat operation for 25 minutes is terminated.

The program then proceeds through the steps S407, S409, S410, S424 to S426, S331 to S333. Then the program makes alternately circulations of the loop including the steps S320 to S324, S327-5 to S327-8 (or S320 to S324, S327-5 to S327-10), S328 to S330, S401, S405 to S407, S409, S410, S424 to S426, S331 to S333 and the loop including the steps S320, S344 to S347, S350-1, S327-6 to S327-8 (or S320, S344 to S347, S350-1, S327-6 to S327-10), S328 to S330, S401, S405 to S407, S409, S410, S424 to S426, S331 to S333. At the step S409, the content in the TIME2 region is subtracted for each second and the content thereof is transferred to the DISPLAY region at the step S425, whereby the same is displayed at the step S328 as the timer left time period. When the program proceeds through the step S426, the display lamp **161*b* is lighted, whereby it is indicated that the displayed content in the display 15 relates the timer operation knob 162*b*. Since the program proceeds through the step S407, the magnetron 15** is enabled to make oscillation with 30% duty, thereby to provide a microwave of 180 W.

When the timer time period of "40 minute" lapses in the above described circulation processes, whereby the timer left time period becomes zero, the same is detected at the step S410. The program then proceeds through the steps S411, S412, S429, S430 to the step S302. As a result, the transistors 143, 131 and 145 are all turned off, whereby a microwave weak heat operation for 40 minutes is terminated, whereupon it is notified by the buzzer 207 (FIG. 6) that all the operations are terminated.

Thereafter the microwave oven enters into the above described standby state and the current time is displayed by the display 15.

[III] Microwave Weak Heat Operation→Microwave Strong Heat Operation

Consider a case where a microwave heat operation of a strong output is performed after a microwave heat operation of a weak output is performed, i.e. in the reversed order as compared with the above described [II] heat operation. In such a case, as in the case of the previous example [II], suitable timer time periods are set by means of the timer operation knobs **162*a* and 162*b***. Then the MICROWAVE WEAK(B) key, the MICROWAVE STRONG key, and the START key are in succession operated.

Upon operation of the MICROWAVE WEAK(B) key, the program proceeds through the steps S507, S523, S525, S526, S529, S530. Upon further operation of the MICROWAVE STRONG key, the program proceeds through the steps S505, S513, S515, S516, S518, S519. Accordingly, if and when the START key is operated in such a case, the same as the previously described example [II] applies; however, the order of the heat operation is reversed, so that a microwave weak heat operation is first performed with 30% duty, whereupon a microwave strong heat operation is performed with 100% duty.

[IV] Microwave Strong Heat Operation→Heater Heat Operation

Now consider a cases where a heat cooking operation is performed for 20 minutes with a strong output microwave and than a further heat cooking operation is performed for 30 minutes at the temperature of 200° C. by means of the heater. As in the case of the previously described example [II] timer operation knobs **162*a* and 162*b* are set to the graduation positions of "20 minutes" and "30 minutes". At the same time the temperature adjustment knob 163** is set to the graduation position of 200° C. and then the MICROWAVE STRONG key, the HEATER key and the START key are operated in succession.

Accordingly, the same processing as the above described example [II] is performed at the operation of the MICROWAVE STRONG key. Upon operation of the HEATER key the program proceeds through the steps S508, S424 to S528. Upon further operation of the START key, as in the case of the previously described example [II], first a strong output microwave is generated for 20 minutes, whereupon the program makes alternatively circulations of the loop including the steps S320 to S324, S327-5 to S327-8 (or S320 to S325, S327-5 to S327-10), S328 to S330, S401, S405, S406, S408 to S410, S424 to S426, S331 to S333 and the loop including the steps S320, S344 to S347, S350-1, S327-6 to S327-8 (or S320, S344 to S347, S350-1, S327-6 to S327-10), S328 to S330, S401, S405, S406, S408 to S410, S424 to S426, S331 to S333. At that time, as in the previously described examples, the timer left time period is displayed and the display lamp **161*b* is lighted. When the program proceeds through the step S406, the heater 137 is energized if and when the temperature in the cooking chamber 12 (FIG. 1) is lower than 200° C. and is deenergized when the temperature in the cooking chamber 12 (FIG. 1**) is higher than 200° C. Accordingly, the temperature in the cooking chamber is maintained approximately at 200° C.

During the above described circulation processes, when the timer time period of "30 minutes" lapses, in the same manner the heater heating operation is terminated and it is notified by the buzzer 207 that all the operations are terminated, whereupon the microwave oven enters into the above described standby state.

[V] Heater Heating Operation→Microwave Strong Heat Operation

Now consider a case where a microwave heat operation is performed with the strong output after the heater heat operation is performed, i.e. in the reversed order of the above described example [IV]. In such a case, as in the case of the previously described example [IV], the timer operation knobs **162*a* and 162*b* and the temperature adjustment knob 163** are set to suitable timer time periods and temperature and then the HEATER key, the MICROWAVE STRONG key, and the START key are operated in succession.

Upon operation of the HEATER key, the program proceeds through the steps S508, S524 to S526, S529, S530. Upon further operation of the MICROWAVE STRONG key, the program proceeds through the steps S505, S513, S515, S516, S518, S519. Accordingly, upon operation of the START key, as in the case of the previously described example [IV] but in the reversed order of the heat operation, first a heater heat operation is performed and then a microwave strong heat operation is performed.

[VI] Microwave Weak Heat Operation→Heater Heat Operation

Now consider a case where a heater heat operation is performed after a microwave heat operation is performed with the weak output. In such a case, as in the previously described examples, the timer time periods and the temperature are similarly and suitably set, and whereupon the MICROWAVE WEAK(A) key, the HEATER key, and the STRAT key are operated in succession, as is readily apparent.

[VII] Heater Heat Operation→Microwave Weak Heat Operation

Now consider a case where a microwave heat operation is performed with the weak output after a heater heat operation is performed, i.e. in the reversed order of the above described example [VI]. In such a case, similarly the timer time periods and the temperature are suitably set, whereupon the HEATER key, the MICROWAVE WEAK(A) key, and the START key are operated in succession, as is readily apparent.

As is apparent from the above described operation modes I to VII, particularly the operation modes I and II specifically described, the microwave oven of the embodiment comprises a standby state for displaying the current time. When the timer operation knob 162*a* or 162*b* is operated so that the brush 24' (see FIG. 5) is displaced exceeding a predetermined position in any state before or after the START key is operated, the new timer time period information corresponding to the knob operated to cause displacement exceeding a predetermined position, i.e. the knob as last displaced is loaded in the regions corresponding to the TIME1 region and the TIME2 region. At least in a state before the START key is operated, the timer time period information corresponding to the knob as last operated for displacement is displayed by the display portion 15.

[VIII] Sole Heat Operation

Now consider a case where only a microwave heat operation is performed with the strong output. In such a case, the timer time period is set by the timer operation knob 162*a*, whereupon the MICROWAVE STRONG key and the START key are operated in succession. Now consider a case where a microwave heat operation is performed with the weak output. In such a case, a timer time period is set by the timer operation knob 162*a*, wereupon the MICROWAVE WEAK(A) key, and the START key are operated, the timer time period is set by the timer operation knob 162*a* and then the MICROWAVE WEAK(B) key and the START key are operated. In order to perform a heater heat operation, first the timer operation knob 162*b* and the timer operation knob 163 are operated to set the time period and the temperature, whereupon the HEATER key and the START key are in succession operated, as is readily apparent.

[IX] Clear Operation

Since the program usually proceeds through the steps S328 and S331, irrespective of whether the microwave oven has been performing a heat operation, the CLEAR key in the operation portion 16 may be operated at any time, when the program proceeds through the steps S331, S501, S502 to return to the step S302, whereupon the microwave unconditionally enters into the standby state.

[X] Interruption of Performance of Heat Operation

Although opening of the door 14 (FIG. 1) of the microwave oven when the microwave oven is not in the heat operation does not affect the control operation by the microprocessor by any means, such opening of the door 14 interrupts the heat operation.

More specifically, since the program proceeds through the step S401 in the course of the heat operation, opening of the door 14 causes the program to proceed through the steps S401 to S404. The heat operation is then terminated at the step S404, whereupon the program makes circulation of the loop including the steps S320 to S324, S327-5 (or S320, S344 to S347, S350-1), S327-6 to S327-8 (or S327-6 to S327-10), S328, S329, S360, insofar as the door 14 is kept open, whereby the timing operation by the timer is interrupted for that period.

When the door 14 is closed thereafter, the program makes circulation of the loop including the steps S320 to S324, S327-5 (or S320, S344 to S347, S350-1), S327-6 to S327-8 (or S327-6 to S327-10), S328, S329, S360, S361, S364, S333. When the START key is then operated, the program proceeds through the steps S360 to S363, S370 to enter to the step S539, whereby the above described heat operation is restarted.

Meanwhile, in the case of the microwave oven such as of the embodiment in discussion, it could happen that the timer operation knob 161*a* or 162*b* and thus the brush 24' (FIG. 5) is undesirably moved due to mechanical vibration without regard to no operation of the knob by an operator. The moving distance in such a case is generally very slight and in any case the displacement thus caused will not exceed one position width of the conductive pattern (FIG. 5A), i.e. the width between the left end and the right end of the fourteenth position. More specifically, the brush 24' will not move from any one position to a further position with the adjacent position therebetween, i.e. from the fourteenth position to the sixteenth position, and in any situation the brush is displaced only within any one position to come to a stop or is displaced to the position adjacent to the above described one position to come to a stop. Accordingly, even if the timer time period could have been changed due to the above described undesired displacement from any one position to the adjacent position, such displacement would be within the minimum unit of 15 seconds at the most. In such a case, the program will not proceed through the step S339 or S355, as to be described subsequently, and the timer time period thus changed incidental to the above described undesired displacement will not be stored in the TIME1 region of the TIME2 region as new timer time period information. More specifically, irrespective of whether the microwave oven is in the heating operation, the program always proceeds through the step S324 or S347. Thus, due to the above described undesired change of the timer time period, the program thereafter proceeds through the step S325 or S348 to the step S326 or S349. However, since the above described undesired change of the timer time period is within the minimum displacement unit, the program thereafter proceeds through the steps S327-5 (or S350-1), S327-6 to S327-8 (or S327-6 to S327-10) to the steps S328 to S333.

If and when mechanical vibration occurs within 5 seconds after the timer operation knob 162*a* or 162*b* is operated by the operator to be displaced, it could happen that the timer time period is changed due to such vibration. More specifically, if and when the knob 162*a* or 162*b* is displaced due to mechanical vibration occurring within 5 seconds after the timer operation knob 162*a* or 162*b* is displaced through operation by the operator, the program proceeds through the step S339 or S355 and accordingly the timer time period information changed due to the undesired mechanical vibration is newly loaded in the TIME1 region or the TIME2 region. More specifically, in accordance with the above described operation mode II, the program proceeds through the steps S324, S325 (or S347, S348), S327-1 to S327-4 (or S350-2, S350-3, S327-3, S327-4), S328 and further through the steps S332 and S334 and further through the steps S335 to S342 (or S351 to S358) and S343. However, since such undesired change of the timer time period was assumed to occur within 5 seconds after the end of manual operation by the operator, the operator readily discerns and notices such change and can make correction immediately.

As seen from the foregoing description, in the embodiment shown it is in either of the following two cases that the timer time period information is loaded in the TIME1 region or the TIME2 region. More specifically, one case is that the timer operation knob 162*a* or 162*b* is operated by the operator and the brush 24' (FIG. 5) is displaced by two or more minimum displacement units in the conductive pattern. The other case is that after such displacement of two or more minimum displacement units described above occurs displacement of one or more minimum displacement unit occurs thereafter within a predetermined time period, say within 5 seconds. Meanwhile, if and when displacement of one or more minimum unit occurs again within 5 seconds after the above described displacement within 5 seconds, such new timer time period information incidental to the new displacement is loaded in the TIME1 region or the TIME2 region; however, after the lapse of a predetermined time period, say more than 5 seconds, since the above described displacement, new timer time period information will not be loaded in the TIME1 region or the TIME2 region, unless the brush 24' (FIG. 5) is displaced of two or more minimum displacement units. More specifically, in the case of the embodiment shown, if and when within 5 seconds after the displacement of two or more minimum displacement units displacement of one or more minimum displacement unit occurs and then within 5 seconds after the last mentioned displacement further displacement of one or more minimum displacement unit occurs, then the timer time period information is renewed. However, the above described renewal of the timer time period information subject to within a predetermined time period, say within 5 seconds, may be limited to a case where the brush 24' has been displaced two or more minimum displacement units previously. Alternatively, the embodiment may be adapted such that such restriction to a predetermined timer period is not considered.

In the above described embodiments, signals are applied to the common terminal 27 (FIG. 4) in the timer knobs 162*a* and 162*b* and the timer time period information was introduced from the first to eighth signal terminals 28*a* to 28*h* (FIG. 4) to the microprocessor in the form of a parallel bit signal; however, alternatively signals are entered into the first to eighth signal terminals 28*a* to 28*h*, while the timer time period information may be introduced from the common terminal 27 into the NT region of the microprocessor in the form of serial bit signal.

In the above described embodiments, the heater heat operation was controlled based on the temperature set by the temperature adjustment knob 163; however, a thermistor circuit for detecting a specific temperature, say 250° C., and a key in the circle indicated as "BLOCK B" in the operation portion 16 may be added for the purpose of performing a heater heat operation by fixing the above described specific temperature to a control reference temperature by means of the said key operation. In such a case, a thermistor of the above described thermistor circuit may be shared with a thermistor of the embodiment.

Figure 10:
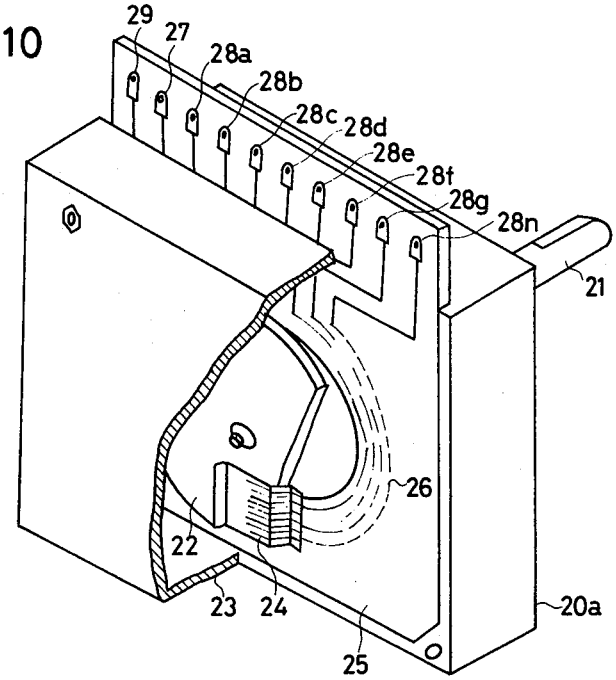
FIG. 10 is a fragmentary perspective view showing another embodiment of the signal generator.
Figure 11B:
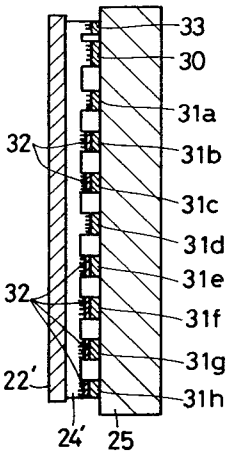
FIGS. 11A and 11B are views for explaining the FIG. 10 signal generator.
Figure 11A:
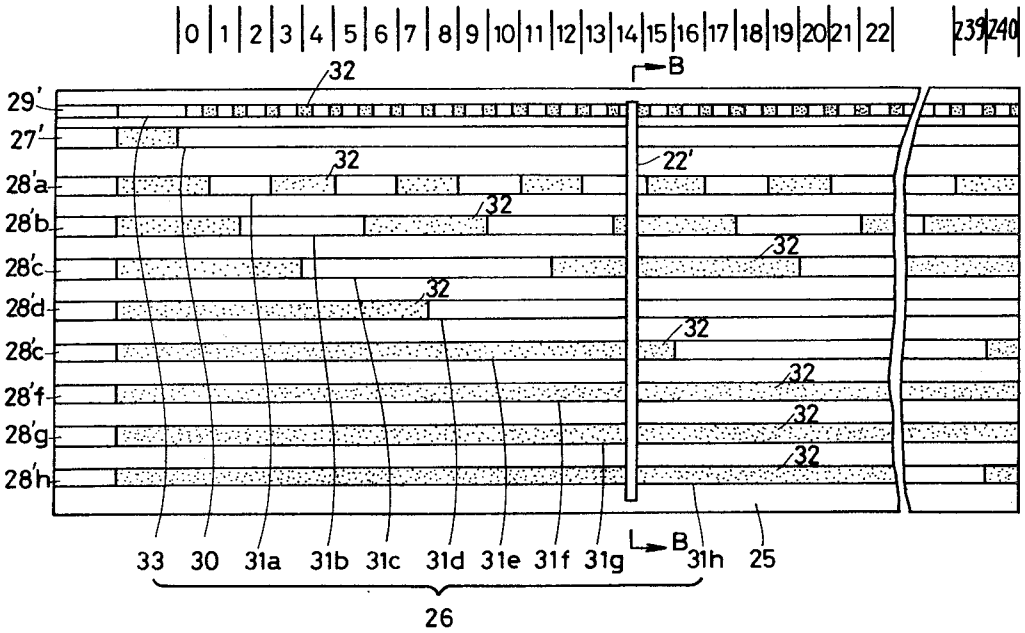

FIG. 10 is a perspective, paritially fragmentary, view showing the signal generator for use in a further embodiment of the present invention. FIGS. 11A and 11B are views showing the relation between the conductive pattern of the FIG. 10 signal generator and the brush. In the case of the embodiment shown in FIGS. 10 and 11, the conductive pattern 26 comprises one common path 30, a first to eighth signal paths 31*a* to 31*h*, and a switching signal path 33. The brush 24 is provided to be movable in sliding contact with the common path 30, the signal paths 31*a* to 31*h* and 33. The switching signal path 33 is structured to have the conductive surface exposed only at the center of each of the 0 position to the 240th position, while the remaining portions are covered with the insulating film 32, as in the case of the signal paths 31*a* to 31*h*.

If and when a pulse signal is applied to the common terminal portion 27' of the common path 30, the pulse signal is also applied through the brush 24' to the switching signal path 33. Now let it be assumed that the brush 24' is at the center of the fourteenth position, for example, as shown in FIG. 11A. Then, since the conductive surface of the switching signal path 33 is exposed at the center position, the pulse signal from the common path 30 is obtained through the switching signal path 33 at the switching terminal portion 29'. Accordingly, assuming that the presence or absence of the pulse signal at the switching terminal portion 29' is allotted to the logic one or zero, respectively, then in the case of the FIG. 11A state the output of the switching terminal portion 29' becomes the logic one. In other words, the logic one is obtained from the switching terminal portion 29' when the brush 24' is at the center of any position, whereas the logic zero is obtained when the brush 24' is in the boundary area between the adjacent positions where the conductive surface of the switching signal path 33 is not exposed. More specifically, the logical state of the switching terminal portion 29' differs depending on whether the brush 24' is at the center at each of the positions.

Figure 12:
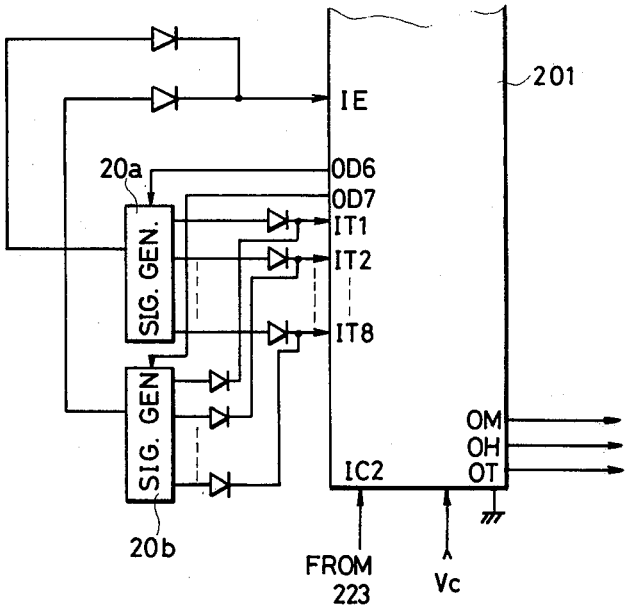
FIG. 12 is a schematic diagram showing a major portion of a further embodiment of the present invention employing the FIG. 10 signal generator.

FIG. 12 is a schematic diagram showing a major portion of a further embodiment of the present invention employing the signal generator described in conjunction with FIGS. 10 and 11. The embodiment shown is substantially the same as the FIG. 6 embodiment, except for the following respects. More specifically, the microprocessor 201 is provided with an input terminal IE to which the signals from the switching terminal portions 29' (FIG. 11A) of the respective signal generators 20*a* and 20*b* are commonly applied through the respective reverse current preventing diodes. Accordingly, it follows that the logic one or zero is applied to the input terminal IE from the switching terminals 29 (FIG. 10) of the respective signal generators 20*a* and 20*b*.

In the FIG. 12 embodiment, the 1-bit ST region, such as shown by the dotted line in FIG. 8, is formed in the random access memory 201*c* included in the microprocessor 201. Furthermore, in the FIG. 12 embodiment, only the FLG1 to FLG11 regions are used as the flag regions. The FLG1 region is used to store whether the timer operation knob and thus the brush is assuredly displaced. The remaining FLG2 to FLG11 regions may be the same as previously described.

Figure 9A:
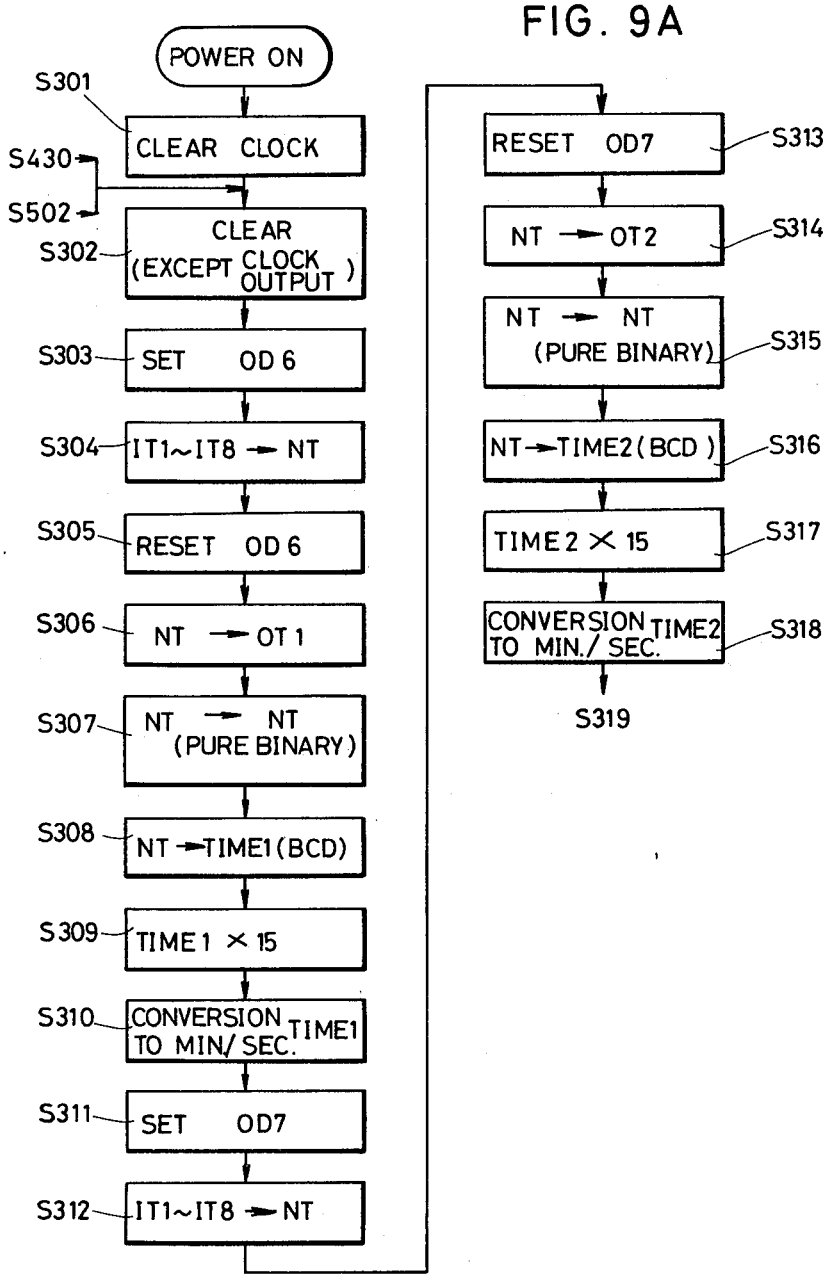
FIGS. 9A to 9H are flow diagrams for explaining a preferred embodiment of the present invention.
Figure 9B:
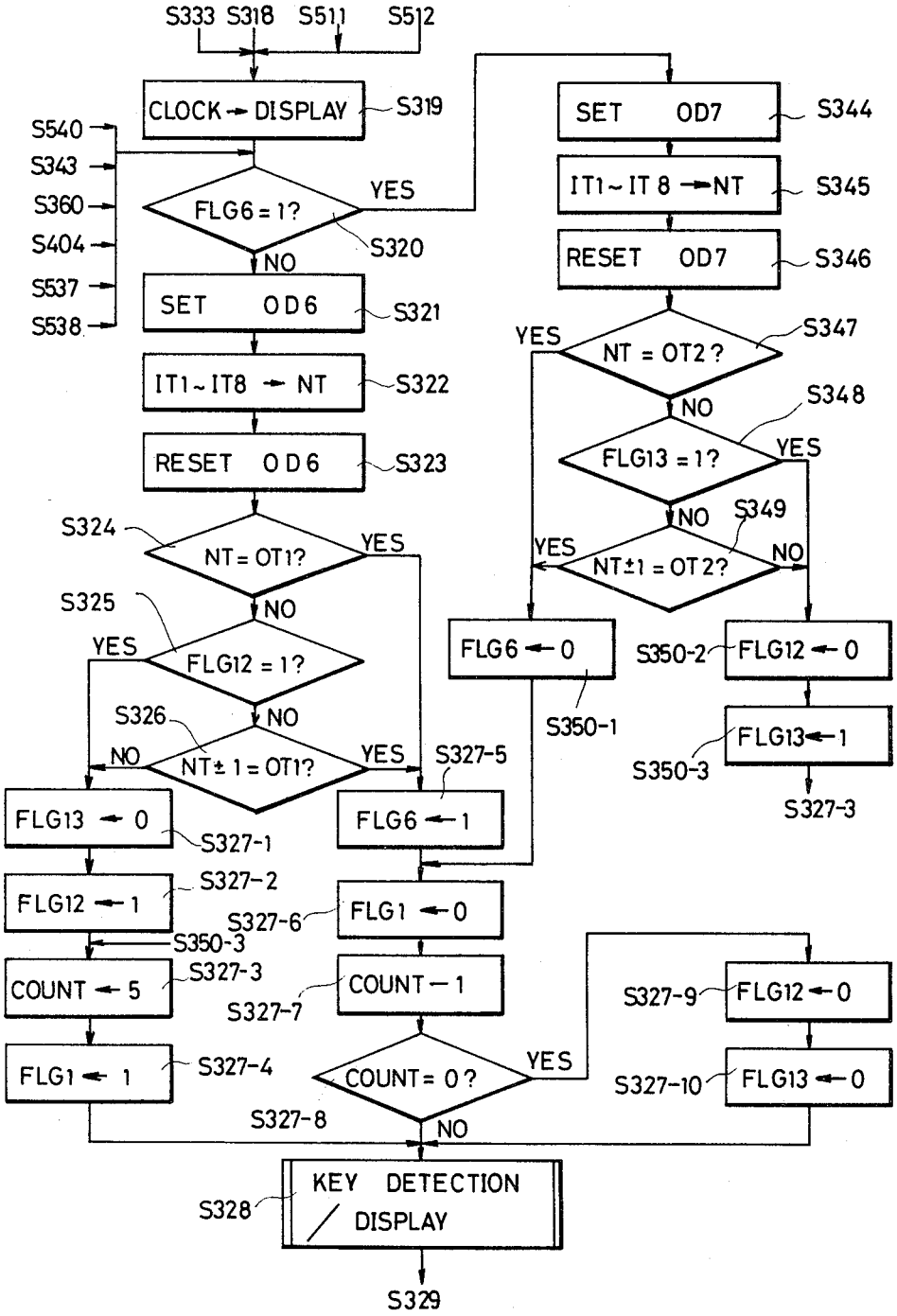
Figure 9C:
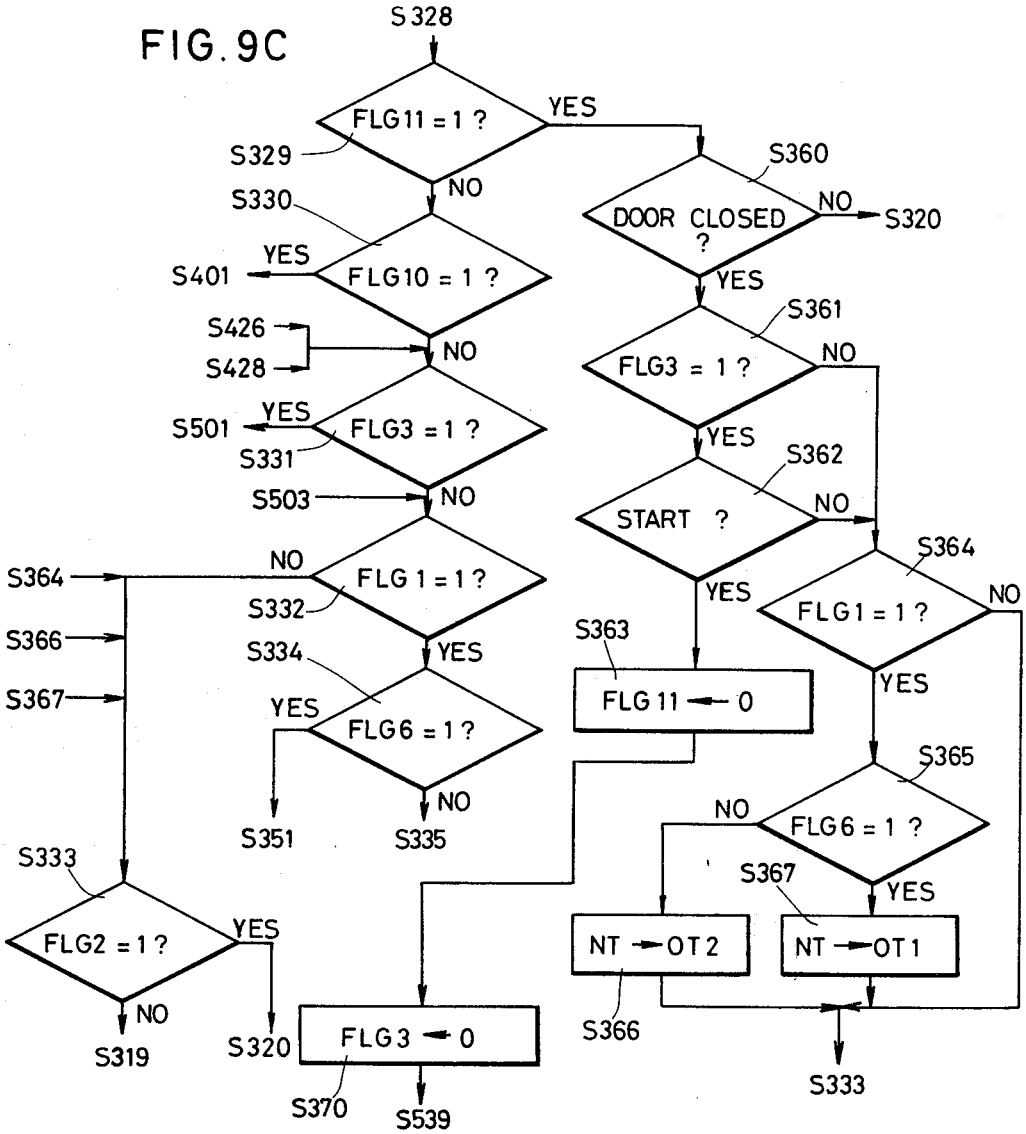
Figure 9D:
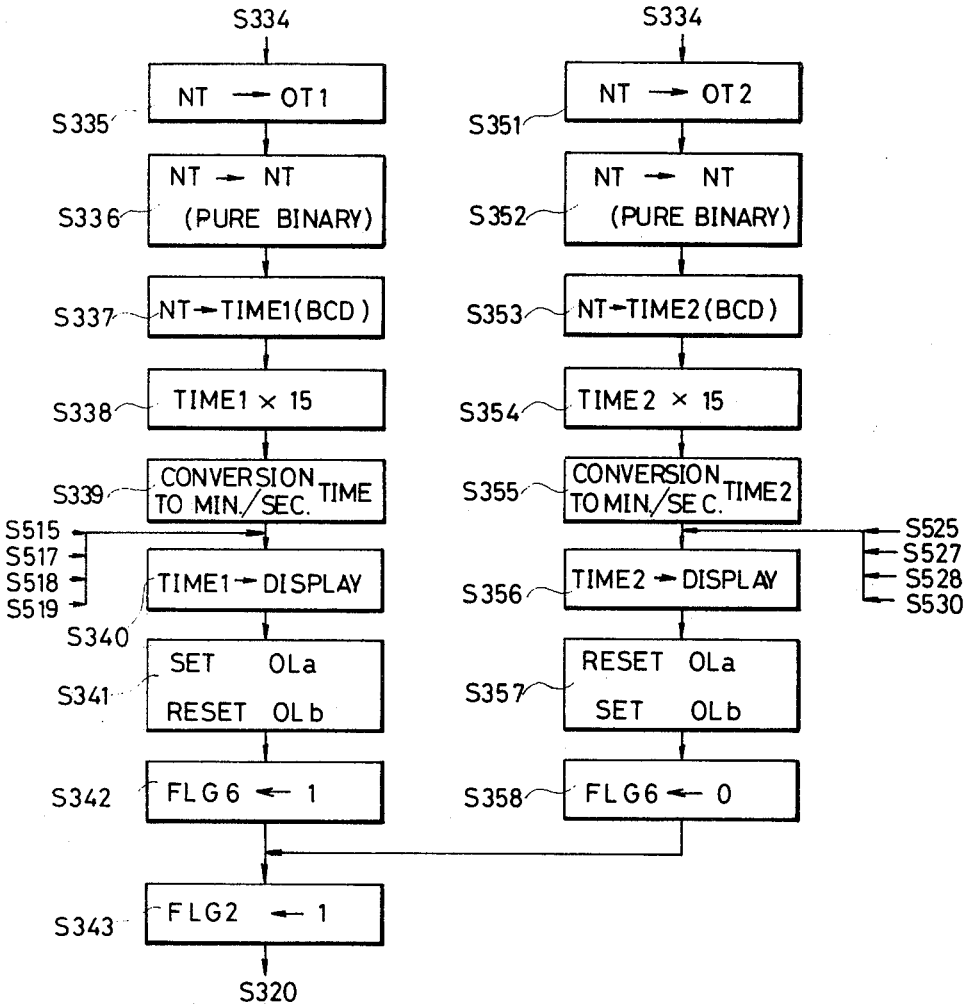
Figure 9E:
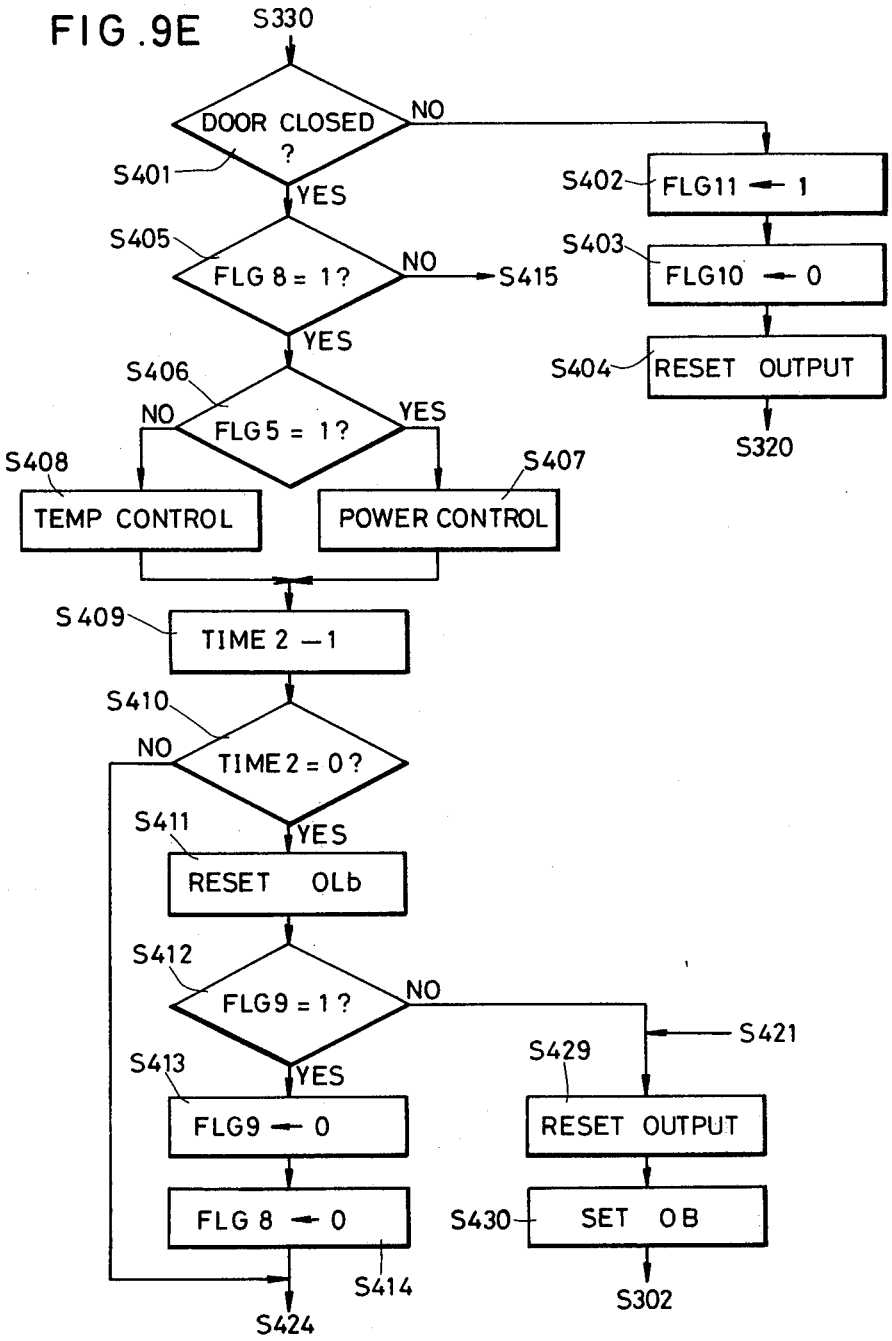
Figure 9F:
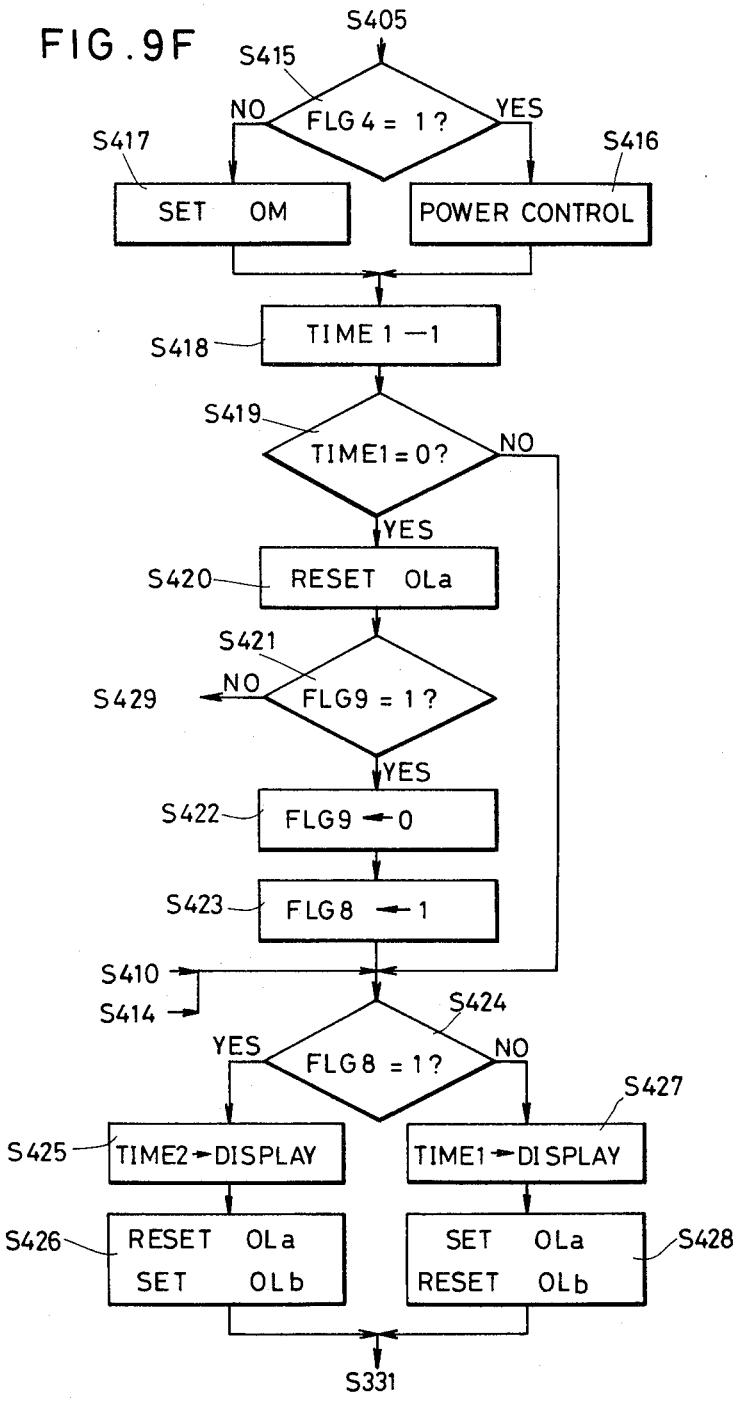
Figure 9G:
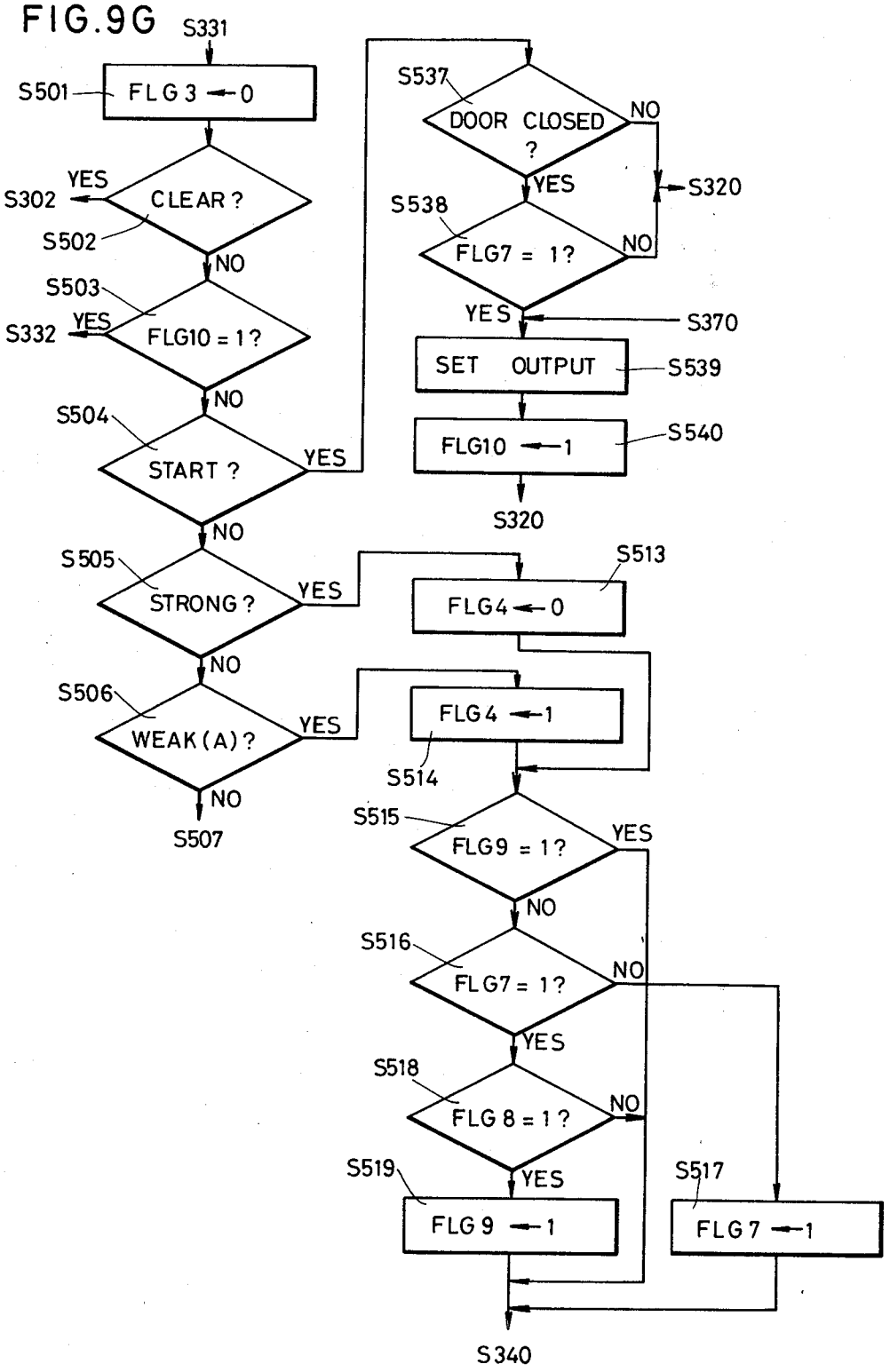
Figure 9H:
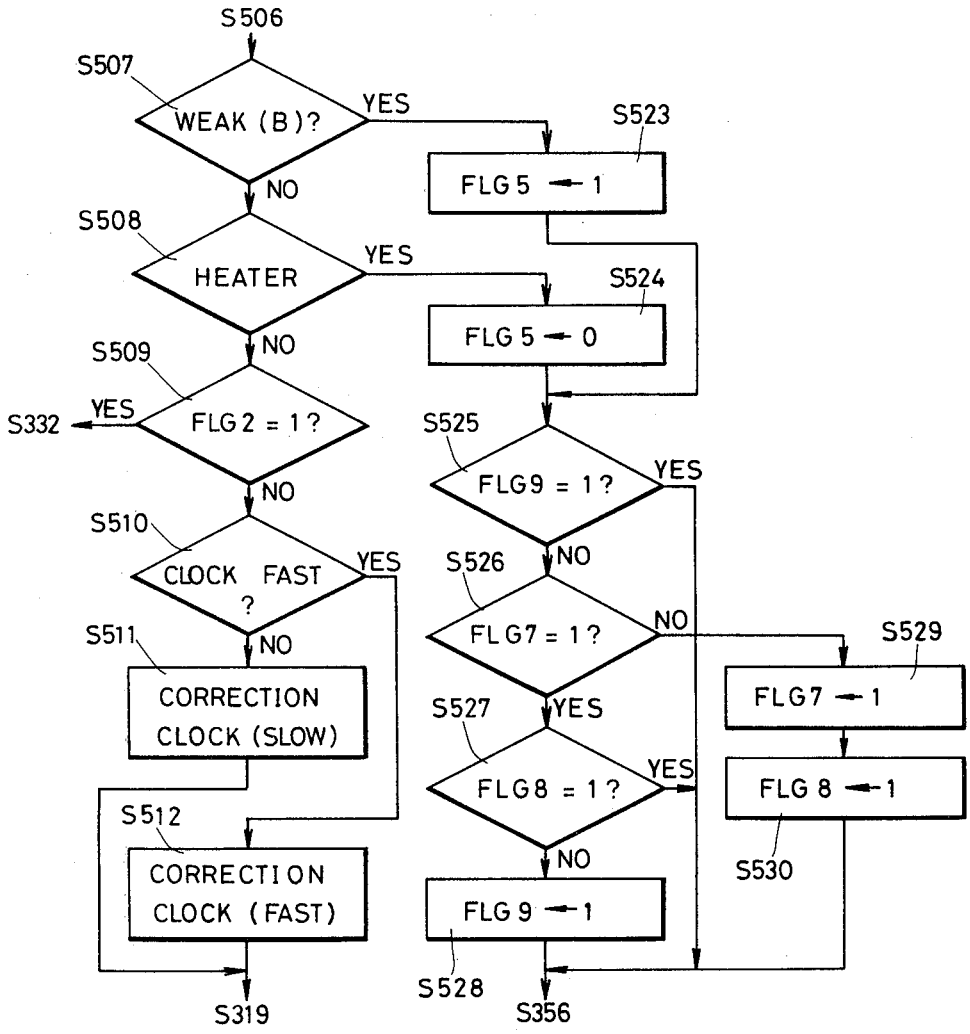
Figure 13:
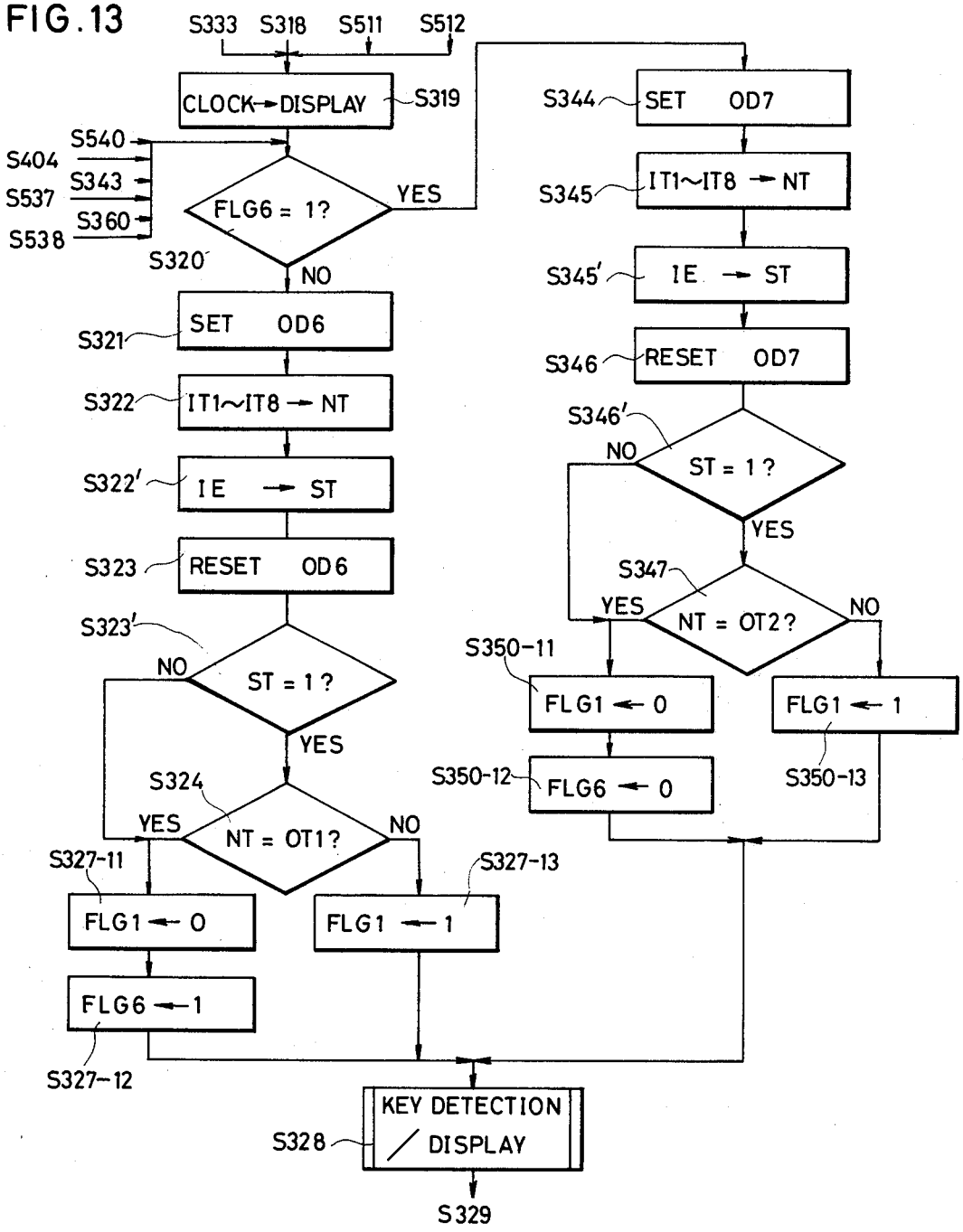
FIG. 13 is a flow diagram explaining a major portion of the operation of the above described further embodiment of the present invention.

FIG. 13 is a flow diagram showing a major portion of the operation of the FIG. 12 embodiment and corresponds to FIG. 9B previously described. Accordingly, in the following the operation of the FIG. 12 embodiment will be described with reference to FIGS. 9A, 13, 9C to 9H.

Before entering into a description of the operation, those steps shown in FIG. 13 but not described yet will be briefly described in the following.

Steps S322', S345': The logic one or zero obtained from the respective signal generators 20*a* and 20*b* being applied to the input terminal IE of the microprocessor is as such stored in the ST region.

Steps S323', S346': It is determined whether the content in the ST region is the logic one.

[I'] Initiation of Power Supply and Current Time Setting

Upon initiation of a power supply to the microwave oven, the program proceeds through the steps S301 to S322, S322', S323 to the step S323'. In this case, insofar as the brush 24' (see FIG. 11A) of the signal generator 20*a* remains at an arbitrary position, for example in the vicinity of the 0 position, among the 0 to 240th positions, the content in the ST region is the logic one. Accordingly, the program proceeds after the step S323' to the step S324. At that time the timer time period loaded at the steps S306 and S322 remains the same unless the timer operation knob 162*a* is turned. Accordingly, the program proceeds after the step S324 through the steps S327-11, S327-12, S328 to S330 to the step S331. Now assuming that no key operation is made by the operation portion 16, the program proceeds from the step S331 through the steps S332 and S333 to return to the step S319. The program further proceeds to the step S320. Since the content in the FLG6 region has become the logic one at that time through the step S327-12, the program then proceeds through the steps S344, S345, S345', S346 to the step S346'. At that time, insofar as the brush 24' of the signal generator 20*b* remains in the vicinity of the zero position, for example, the content in the ST region is the logic one and therefore the program proceeds after the step S346' to the step S347. The timer time period loaded at the steps S314 and S345 remains the same unless the timer operation knob 162*b* is turned. Accordingly, the program proceeds after the step S347 through the steps S350-11 and S350-12 to return to the step S328. Accordingly, similarly thereafter the program makes alternately circulations of the first loop including the steps S319 to S322, S322', S323, S323', S324, S327-11, S327-12 and S328 to S333 and the second loop including the steps S319, S320, S344, S345, S345', S346, S346', S347, S350-11, S350-12 and S328 to S333. In the course of the above described circulations, the content in the CLOCK region is transferred to the DISPLAY region at the step S319 and is displayed by the display 15 at the step S328. Although the content displayed is a current time display, the displayed current time is incorrect, since the current time setting has not been made at that time.

When the CLOCK FAST key or the CLOCK SLOW key is depressed for the purpose of setting the current time, the key operation is detected at the step S331 in the above described circulation process. Thereafter the program proceeds from the step S331 to the step S501, whereupon the program proceeds through the steps S502 to S510 and further through the step S511 or S512 to return to the step S319. Accordingly, insofar as the CLOCK FAST key or the CLOCK SLOW key is kept depressed, the program makes circulation of the steps S319, S322, S322', S323, S323', S324, S327-11, S327-12 (or S319, S320, S344, S345, S345', S346, S346', S347, S350-11, S350-12), S328 to S331, S501 to S510 and S511 or S512, whereby a displayed current time in the display 15 quickly changes during that time period.

At the time point when the displayed current time reaches a correct current time, the above described key is released from being depressed, whereupon the program again makes circulation of the above described first loop or the second loop, while the correct current time is displayed by the display 15. Such state is a standby state.

[II'] Microwave Strong Heat Operation→Microwave Weak Heat Operation

Consider a case where a heat cooking operation is performed for 25 minutes with a microwave of a strong output (600 W) and then a heat cooking operation is performed for 40 minutes with a microwave of a weak output (180 W). In such a case, first of all the timer operation knobs 162*a* and 162*b* are set to the graduation positions of 25 minutes and 40 minutes, respectively, in the operation portion 16.

Assuming that the timer operation knob 162*a* is first operated, then such timer operation is detected at the step S324 in the above described standby state and the program then proceeds through the steps S327, S327-13, S328 to S332 and S334 to S343. More specifically, the new timer time period information of "25 minutes" is loaded in the TIME1 region at the step S339 and the same is also transferred to the DISPLAY region at the step S340. Furthermore, only the display lamp 161*a* is lighted at the step S341. The program then makes alternately circulations of the third loop including the steps S320, S344, S345, S345', S346, S346', S347, S350-11, S350-12, S328 to S333 and the fourth loop including the steps S320 to S322, S322', S323, S323', S324, S327-11, S327-12, S328 to S333. During the circulation period the timer time period information of "25 minutes" is displayed at the step S328 and the display lamp 161*a* is also lighted, whereby it is notified that the displayed content in the display 15 contains the time period information associated with the timer operation knob 162*a*.

Assuming that the timer operation knob 162*b* is then operated, such operation is detected at the step S347 in the above described third loop circulation and the program then proceeds through the steps S350-13, S328 to S332 to S334, S351 to S358, S343. More specifically, the new timer time period of "40 minutes" is loaded in the TIME2 region at the step S355. At the same time the timer time period information is transferred to the DISPLAY region at the step S356 and only the display lamp 161*b* is lighted at the step S357. Thus the program thereafter makes alternately the circulations of the above described third and fourth loops, while the timer time period information of "40 minutes" is similarly displayed by the display 15 and the display lamp 161*b* is lighted, whereby it is notified that the displayed content in the display 15 contains the time period information associated with the timer operation knob 162*b*.

As for the order of operation of the timer operation knobs 162*a* and 162*b*, either may be earlier operated and the timer period information designated by the knobs 162*a* and 161*b* is loaded in the respective TIME1 and TIME2 regions. The timer period information of the last operated knob is displayed by the display 15 and the display lamp 161*a* or 161*b* is lighted, whereby it is indicated which knob the displayed content in the display 15 corresponds to.

Then the MICROWAVE STRONG key, the MICROWAVE WEAK(B) key, and the START key are operated in succession.

The key operation of the MICROWAVE STRONG key is detected at the step S331 in the above described circulations of the third and fourth loops. Then the program proceeds through the steps S501 to S505, S513, S515 to S517, S340 to S343, while the key operation of the MICROWAVE STRONG key is loaded at the step S513. The key operation of any one of the keys in the circle indicated as "BLOCK A" in the operation portion 16 is stored at the step S517. The content in the TIME1 region is transferred to the DISPLAY region at the step S340 and only the display lamp 161*a* is lighted at the step S341. Insofar as the MICROWAVE STRONG key is kept operated, the program makes alternately circulations of the loop including the steps S320, S344, S345, S345', S346, S346', S347, S350-11, S350-12, S328 to S331, S501 to S505, S513, S515, S516, S518, S340 to S343 and the loop including the step S320 to S322, S322', S323, S323', S324, S327-11, S327-12, S328 to S331, S501 to S505, S513, S515, S516, S518, S340 to S343. When the above described key operation is released, the program makes alternately circulations of the fourth loop including the steps S320 to S322, S322', S323, S323', S324, S327-11, S327-12, S328 to S333 and the third loop including the steps S320, S344, S345, S345', S346, S346', S347, S350-11, S350-12, S328 to S333. During the above described circulation processes, the time period information designated by the timer operation knob 162*a* is displayed by the display 15 and the display lamp 162*a* is lighted.

The following key operation of the MICROWAVE WEAK(B) key is detected at the step S331 in the course of the above described circulation processes of the third and fourth loops. Then the program proceeds through the steps S501 to S507, S523, S525 to S528, S356 to S358, S343, while the key operation of the MICROWAVE WEAK(B) key is stored at the step S523. The key operation of any keys in the circles indicated as "BLOCK A" and "BLOCK B" of the operation portion 16 is stored at the step S528. At the step S356 the content in the TIME2 region is transferred to the display region and at the step S357 only the display lamp 161*a* is lighted. Insofar as the MICROWAVE WEAK(B) key is kept operated, the program makes alternately circulations of the loop including the steps S320 to S322, S322', S323, S323', S324, S327-11, S327-12, S238 to S331, S501 to S507, S523, S525, S356 to S358, S343 and the loop including the steps S320, S344, S345, S345', S346, S346', S347, S350-11, S350-12, S328 to S331, S501 to S507, S523, S525, S356 to S358, S343. When the above described key operation is released, the program makes alternately circulations of the fourth loop including the steps S320 to S322, S322', S323, S323', S324, S327-11, S327-12, S328 to S333 and the third loop including the steps S320, S344, S345, S345', S346, S346', S347, S350-11, S350-12, S328 to S333. In the course of the above described circulation processes, the time period information designated by the timer operation knob 162*b* is displayed and the display lamp 161*b* is lighted.

The content in the FLG8 region remains the logic zero depending on the order of operation of the above described MICROWAVE STRONG key and the MICROWAVE WEAK(B) key. This means that the key in the circle indicated as "BLOCK A" of the operation portion 16 is operated prior to the operation of the key in the circle indicated as "BLOCK B".

The final operation of the START key is detected at the step S331 in the above described circulation processed of the third and fourth loops and the program then proceeds through the steps S501 to S504, S537 to S540. At that time, the transistor 145 (FIG. 6) is turned on at the step S539. The program then proceeds through the steps S320 to S322, S322', S323, S323', S324, S327-11, S327-12, (or S320, S344, S345, S345', S346, S346', S347, S350-11, S350-12), S328 to S330, S401, S405, S415, S417 to S419, S424, S427, S428, S331. The transistor 131 is turned on at the step S417 and accordingly oscillation of the magnetron 105 is started.

Insofar as the START key is kept operated, the program proceeds after the step S331 to the step S501, whereupon the program proceeds through the steps S502, S503 to the step S332 and then returns from the step S333 to the step S320.

When the above described key operation is released the program proceeds after the step S331 through the steps S332, S333 to return to the step S320. Thereafter, the program makes alternately circulations of the loop including the steps S320, S344, S345, S345', S346, S346', S347, S350-11, S350-12, S328 to S330, S401, S405, S415, S417 to S419, S424, S427, S428, S331 to S333 and the loop including the steps S320 to S322, S332', S323, S323', S324, S327-11, S327-12, S328 to S330, S401, S405, S415, S417 to S419, S424, S427, S428, S331 to S333. At the step S418 the content in the TIME1 region is subtracted for each second and the content thereof is transferred to the DISPLAY region at the step S427, whereby the same is displayed at the step S328 as the timer left time period. The program proceeds through the step S428, when the display lamp 161*a* is lighted, whereby it is indicated that the displayed content in the display 15 relates to the timer operation knob 162*a*. Since the transistors 145 and 131 are kept on during that period, the magnetron 105 is enabled to make continuous oscillation, i.e. with 100% duty, thereby to provide a microwave of 600 W.

If and when the timer time period of "25 minutes" passes, so that the timer left time period becomes zero during the above described circulation processes, the same is detected at the step S419 and the program proceeds through the steps S420 to S426, S331 to S333, S320 to S322, S322', S323, S323', S324, S327-11, S327-12 (or S320, S344, S345, S345', S346, S346', S347, S350-11, S350-12), S328 to S330, S401, S405 to the step S406. More specifically, this means that a microwave strong heat operation for 25 minutes is terminated.

The program then proceeds through the steps S407, S409, S410, S424 to S426, S331 to S333. Then the program makes alternately circulations of the loop including the steps S320 to S322, S322', S323, S323', S324, S327-11, S327-12, S328 to S330, S401, S405 to S407, S409, S410, S424 to S426, S331 to S333 and the loop including the steps S320, S344, S345, S345', S346, S346', S347, S350-11, S350-12, S328 to S330, S401, S405 to S407, S409, S410, S424 to S426, S331 to S333. At the step S409, the content in the TIME2 region is subtracted for each second and the content thereof is transferred to the DISPLAY region at the steps S425, whereby the same is displayed at the step S328 as the timer left time period. When the program proceeds through the step S426, the display lamp 161*b* is lighted, whereby it is indicated that the displayed content in the display 15 relates the timer operation knob 162*b*. Since the program proceeds through the step S407, the magnetron 15 is enabled to make oscillation with 30% duty, thereby to provide a microwave of 180 W.

When the timer time period of "40 minute" lapses in the above described circulation processes, whereby the timer left time period becomes zero, the same is detected at the step S410. The program then proceeds through the steps S411, S412, S429, S430 to the step S302. As a result, the transistors 143, 131 and 145 are all turned off, whereby a microwave weak heat operation for 40 minutes is terminated, whereupon it is notified by the buzzer 207 (FIG. 6) that all the operation are terminated.

Thereafter the microwave oven enters into the above described standby state and the current time is displayed by the display 15. As is clear from the operation mode of the above described I' and II', in any situation before and after the START key is operated in the standby state, the program always periodically passes the step S324 or S347 and the steps S328 and S332. Meanwhile, since the corresponding operations of the FIG. 12 embodiment are substantially the same as the previously described operation modes III to X of the previously described embodiment, a more detailed description is omitted. However, the program step in the case where the door 14 is in an opened state and the program step in the case where the door 14 is closed are slightly different. More specifically, insofar as the door 14 is in an opened state, the program makes circulation of the loop including the steps S320 to S322, S322', S323, S323', S324, S327-11, S327-12 (or S320, S344, S345, S345', S346, S346', S347, S350-11, S350-12), S328, S329 and S360, during which time period the timing operation of the timer is suspended. When the door is closed thereafter, it follows that the program makes circulation of the loop including the steps S320 to S322, S322', S323, S323', S324, S327-11, S327-12 (or S320, S344, S345, S345', S346, S346', S347, S350-11, S350-12), S328, S329, S360, S361, S364 and S333.

Now consider a case where undesired displacement has occurred not due to an operation of the timer operation knob 162*a* or 162*b* by an operator but due to mechanical vibration. The moving distance of the brush 24' in such case is generally slight and it is extremely rare that the brush 24' moves more than the length of the insulating film 32 in the switching signal path 33 (FIG. 11A). More specifically, the brush 24' extremely seldom move in the switching signal path 33 from one conductive surface through the adjacent insulating film to the other conductive surface and in most cases stops on the insulating film 32 in the boundary of the respective adjacent positions. Accordingly, no new timer time period information is stored in the TIME1 or TIME2 region responsive to the above described undesired displacement of such mechanical vibration. More specifically, irrespective of whether the microwave oven is in a heating operation, the program always passes the step S323' or S346'. Since the logic zero has been set in the ST region in such a case, thereafter the program proceeds through the respective steps S327-11, and S327-12 (or S350-11, S350-12) to the subsequent step S328 to the steps S332 and S333.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electronic controlled cooking apparatus, comprising:

heating energy generating means for providing heating energy to a material being cooked, timer means for defining a cooking time period of a cooking operation by said heating energy generating means, said timer means comprising a displacement member provided to be displaceable over any section of a predetermined range from an origin point for setting an initial timer time period, said predetermined range being divided into a plurality of sections each of which corresponds to a different timer time period, means responsive to displacement of said displacement member for generating a unique code signal for each said section associated with the displacement amount of said displacement member from said origin point, timer time period information storing means for storing the code signals generated by said code signal generating means, control means responsive to said timer time period information stored in said timer time period information storing means for controlling said heating energy generating means, first displacement detecting means for providing a first output only upon said displacement member having been first displaced by more than a first predetermined amount from the point as set by the initial setting of said displacement member, said timer time period information storing means responsive to said first output for storing new timer time period information determined by said unique code signal obtained from said code signal generating means.

2. An electronic controlled cooking apparatus in accordance with claim 1, wherein said code signal generating means comprises a plurality of conductive paths extending over said predetermined range from said origin point, and a conductive path common to said plurality of conductive paths, and said displacement member of said timer means comprises a conductive member provided to be simultaneously in sliding contact with said plurality of conductive paths and common conductive path, said apparatus further comprising signal applying means for applying a signal to said plurality of conductive paths through said common conductive path and said conductive member, and unique code signal withdrawing means for withdrawing said applied signal from said plurality of conductive paths as a unique code signal corresponding to the position of said displacement member, said plurality of conductive paths being structured such that the conductive surfaces thereof are selectively in contact with said conductive member, thereby to provide said unique code signal which is different for each said section of said predetermined range.

3. An electronic controlled cooking apparatus in accordance with claim 2, wherein said first displacement detecting means detects displacement of more than said first predetermined amount of said displacement member responsive to a change of said unique code signal obtained from said code signal generating means.

4. An electronic controlled cooking apparatus in accordance with claim 3, wherein said first predetermined amount is selected to correspond to the length of one of said sections of said predetermined range.

5. An electronic controlled cooking apparatus in accordance with claim 1, which further comprises second displacement detecting means for providing a second displacement output when it detects said displacement member having been displaced a second time by more than a second predetermined amount from the point set by said first displacement, and renewal means responsive to the output of said second displacement detecting means for renewing said new timer time period information stored in said timer time period information storing means according to the signal obtained from said code signal generating means.

6. An electronic controlled cooking apparatus in accordance with claim 5, wherein said second predetermined amount is selected to be different from said first predetermined amount.

7. An electronic controlled cooking apparatus in accordance with claim 6, which further comprises time period determining means for determining whether a predetermined time period has lapsed before said second displacement output occurs and after said first displacement output has been provided by means of said first displacement detecting means, and wherein said renewal means is adapted to renew said new timer time period information if and when said second displacement output is obtained from said second displacement detecting means after obtaining said first displacement output from said first displacement detecting means and before the lapse of said predetermined time period is determined by said time period determining means.

8. An electronic controlled cooking apparatus in accordance with claim 2, wherein said first displacement detecting means comprises switch means switchably responsive to displacement of said displacement member for each said section of said predetermined range for detecting displacement of said displacement member responsive to switching of said switch means.

9. An electronic controlled cooking apparatus in accordance with claim 8, wherein said switch means comprises a switching conductive path structured in be in contact with said conductive member over said predetermined displacement range of said displacement member, and said switching conductive path is structured to have a conductive surface exposed to said conductive member only when said displacement member is in the vicinity of the center of each said section.

10. An electronic controlled cooking apparatus in accordance with claim 9, wherein said switch means comprises switch signal withdrawing means for withdrawing a signal from said switching conductive path, and said first displacement detecting means detects displacement of said displacement member by more than said predetermined amount responsive to the switch signal obtained from said switch signal withdrawing means.

11. An electronic controlled cooking apparatus in accordance with claim 5 which further comprises:

time period determining means for determining whether a predetermined time period has lapsed after displacement of said displacement member is detected by means of both of said first and second displacement detecting means, and wherein said renewal means is adapted to renew and timer time period information again if and when another second displacement output is obtained from said second displacement detecting means after obtaining an initial second displacement output from said second displacement detecting means and before the lapse of said predetermined time period is determined by said time period determining means.

* * * * *